US007521173B2

(12) United States Patent
Dontula et al.

(10) Patent No.: US 7,521,173 B2
(45) Date of Patent: Apr. 21, 2009

(54) EXTRUDABLE ANTISTATIC TIELAYERS

(75) Inventors: Narasimharao Dontula, Rochester, NY (US); Terry A. Heath, Omaha, NE (US); Somsack Chang, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/683,446

(22) Filed: Mar. 8, 2007

(65) Prior Publication Data

US 2008/0220353 A1 Sep. 11, 2008

(51) Int. Cl.
*G03C 1/85* (2006.01)
*B41M 5/00* (2006.01)

(52) U.S. Cl. ..... 430/527; 430/62; 430/201; 430/205; 503/227; 428/32.39

(58) Field of Classification Search ..... 430/201, 430/205, 527, 62; 503/227; 428/32.39
See application file for complete search history.

(56) References Cited

U.S. PATENT DOCUMENTS 4,695,286 A 9/1987 Vanier et al.
4,897,377 A 1/1990 Marbrow
4,908,345 A 3/1990 Egashira et al.
4,927,803 A 5/1990 Bailey et al.
5,112,799 A 5/1992 Egashira et al.
5,244,861 A 9/1993 Campbell et al.
5,302,574 A 4/1994 Lawrence et al.
5,387,571 A 2/1995 Daly
5,858,916 A 1/1999 Kung et al.
6,291,396 B1 9/2001 Bodem et al.
6,897,183 B2 5/2005 Arrington et al.
7,091,157 B2 8/2006 Kung et al.
2004/0167020 A1 8/2004 Arrington et al.

*Primary Examiner*—Amanda C. Walke
(74) *Attorney, Agent, or Firm*—Lynne M. Blank; Kathleen Neuner Manne

(57) ABSTRACT

The present invention relates to an extruded imaging element comprising an extruded support bearing an extruded image receiving layer and an extruded antistatic tie layer between the extruded support and the extruded image receiving layer, wherein the extruded tie layer absorbs less than 3 weight % of moisture at 80% RH and 70 F (22.78° C.) comprises 5-30% polyether-containing antistatic material in a matrix polymer, and a method for making the same.

27 Claims, No Drawings

EXTRUDABLE ANTISTATIC TIELAYERS

FIELD OF THE INVENTION

The present invention relates to an extrudable antistatic tie layer for enhancing the adhesion of an image receiving layer to a support or substrate bearing the layer.

BACKGROUND OF THE INVENTION

In recent years, thermal transfer systems have been developed to obtain prints from pictures that have been generated from a camera or scanning device. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other two colors. A color hard copy is thus obtained which corresponds to the original picture viewed on a screen.

Dye receiving elements used in thermal dye transfer generally include a support (transparent or reflective) bearing on one side thereof a dye image-receiving layer, and optionally additional layers. The dye image-receiving layer conventionally comprises a polymeric material chosen from a wide assortment of compositions for its compatibility and receptivity for the dyes to be transferred from the dye donor element. Dye must migrate rapidly in the layer during the dye transfer step and become immobile and stable in the viewing environment. Care must be taken to provide a receiving layer which does not stick to the hot donor as the dye moves from the surface of the receiving layer and into the bulk of the receiver. An overcoat layer can be used to improve the performance of the receiver by specifically addressing these latter problems. An additional step, referred to as fusing, may be used to drive the dye deeper into the receiver.

In sum, the receiving layer must act as a medium for dye diffusion at elevated temperatures, yet the transferred image dye must not be allowed to migrate from the final print. Retransfer is potentially observed when another surface comes into contact with a final print. Such surfaces may include paper, plastics, binders, backside of (stacked) prints, and some album materials.

A variety of polymers are known to be useful in image-receiving layers. Such polymers include, polycarbonates, bisphenol-A polycarbonates, as set forth in U.S. Pat. No. 4,695,286 and U.S. Pat. No. 4,927,803, both incorporated herein by reference, polyesters formed from aromatic diesters (such as disclosed in U.S. Pat. No. 4,897,377, incorporated herein by reference), polyesters formed from alicyclic diesters are disclosed in U.S. Pat. No. 5,387,571 of Daly, incorporated herein by reference, phenyl group (e.g. bisphenol A) modified polyester resin synthesized by the use of a polyol having a phenyl group as the polyol compound as disclosed in U.S. Pat. No. 4,908,345 to Egashira et al., incorporated herein by reference, a polyester resin having a branched structure as disclosed in U.S. Pat. No. 5,112,799, incorporated herein by reference. Blends of polymers are also useful, for example, a miscible blend of an unmodified bisphenol-A polycarbonate having a number molecular weight of at least about 25,000 and a polyester as disclosed in U.S. Pat. No. 5,302,574 to Lawrence et al., incorporated herein by reference, and unmodified bisphenol-A polycarbonates of the type described in U.S. Pat. No. 4,695,286, incorporated herein by reference, may be blended with the modified polycarbonates of the type described in U.S. Pat. No. 4,927,803, incorporated herein by reference.

U.S. Pat. No. 6,897,183, incorporated herein by reference, relates to a process for making a multilayer film, useful in an image recording element, where the multilayer film comprises a support and an outer or surface layer wherein between the support and the outer layer is an "antistatic tie layer" comprising a thermoplastic antistatic polymer or composition having preselected antistatic properties, adhesive properties, and viscoelastic properties. In one embodiment of the invention, such a multilayer film is used in making a thermal-dye-transfer dye-receiver element comprising a support and an dye-receiving layer wherein between the support and the dye-receiving layer is a tie layer. However in U.S. Pat. No. 6,897,183, no mention of importance of tie layer adhesion to the dye receiver layer and to the support during printing and immediately after printing is made. Also, no mention is made of the importance of printing under hot and humid conditions, and lack of humidity sensitivity of the tie layer compositions. A preferred tie layer composition that takes into account the above factors is not disclosed in the reference. U.S. Patent Publication No. 2004/0167020, incorporated herein by reference, is also similar to U.S. Pat. No. 6,897,183 in that it does not make any references to adhesion of the dye receiver layer to the support during printing, immediately after printing, printing under hot and humid conditions, humidity sensitivity of tie layer compositions and preferred tie layer composition that takes into account these factors.

Known polymer laminates used on the faceside of thermal receivers have a top skin layer of polypropylene (PP) onto which is extruded a dye receiver layer (DRL) of polyester/polycarbonate blend. A conventional tie layer used between the laminate support and the dye receiving layer (DRL) is antistatic and is a blend of 70 wt % PELESTAT® 300 (polyethylene-polyether copolymer) and 30 wt % polypropylene (PP). The rheology of the two components is such that PELESTAT® 300 encapsulates the polypropylene (PP), so that the continuous phase in the tie layer is PELESTAT® 300. The PELESTAT® 300 acts as an antistatic material as well as an adhesive component to polymer laminate support skin layer and the dye receiving layer (DRL). This tie layer, however, is significantly humidity sensitive and has poor adhesion and does not survive borderless printing (edge to edge) when tested under hot and humid conditions like 36° C./86% RH.

PROBLEM TO BE SOLVED

There remains a need for enhanced adhesion between supports and substrates and receiving layers extruded onto the substrates or supports to avoid delamination during printing, especially when adhesion is negatively affected by humidity. It would also be desirable for the image-receiving layer to be readily applied to the underlying support without inadequate adhesion. It would be desirable if a tie layer for adhering the image-receiving layer to the support for the recording element could provide not only improved adhesion but additionally provide antistatic properties to the recording element.

SUMMARY OF THE INVENTION

The present invention relates to an extruded imaging element comprising an extruded support bearing an extruded image receiving layer, and an extruded antistatic tie layer between the extruded support and the extruded image receiving layer, wherein the extruded tie layer absorbs less than 3 weight % of moisture at 80% RH and 70 F (22.78° C.) comprises 5-30% polyether-containing antistatic material in a matrix polymer. The present invention also relates to a method of making an extruded imaging element comprising providing an extruded support, extruding an antistatic tie layer onto said extruded support, wherein said antistatic tie layer absorbs less than 3 weight % of moisture at 80% RH and 70 F (22.78° C.) comprises 5-30% polyether-containing antistatic material in a matrix polymer, and extruding an image receiving layer onto said extruded support and said antistatic tie layer.

ADVANTAGEOUS EFFECT OF THE INVENTION

The present invention includes several advantages, not all of which are incorporated in a single embodiment. The tie layer of the present invention provides enhanced adhesion, especially in situations where adhesion is humidity sensitive, between supports and substrates and receiving layers extruded onto the substrates or supports to avoid delamination, especially around perforations, and other cut, slit, or perforated edges. The inventive tie layer also provides antistatic properties.

DETAILED DESCRIPTION OF THE INVENTION

The present invention relates to a multilayer film, useful in an image recording element, which comprises a support and an "antistatic tie layer" between the support and imaging layers applied to the support. The tie layer is an extruded tie layer and has preselected antistatic properties, adhesive properties, and viscoelastic properties. In one embodiment of the invention, such a multilayer film is used in making a thermal-dye-transfer dye-receiver element comprising a support and an dye-receiving layer wherein between the support and the dye-receiving layer is a tie layer. The tie layer is preferably used in an extruded imaging element comprising an extruded support bearing an extruded image receiving layer with an extruded antistatic tie layer therebetween, wherein the extruded tie layer comprises 5-30 weight (wt.) % polyether containing antistatic material in a matrix polymer.

The terms as used herein, "top", "upper", "emulsion side", and "face" mean the side or toward the side of the imaging member bearing the imaging layers. The terms "bottom", "lower side", and "back" mean the side or toward the side of the imaging member opposite from the side bearing the imaging layers or image. The term "void" as used in "voided polymer" is used herein to mean devoid of added solid or liquid matter, although it is likely the "voids" contain gas. The term "voided polymers" will include materials comprising microvoided polymers and microporous materials known in the art. A foam or polymer foam formed by means of a blowing agent is not considered a voided polymer for purposes of the present invention.

The present invention involves a tie layer whose composition is humidity insensitive, and which provides enhanced adhesion to the support and image receiving layer, and required antistatic properties to the image recording element. The tie layer may be any suitable material that does not have a harmful effect upon the element. The preferred materials are melt extrudable polymers.

The tie layer comprises a matrix polymer or binder. If formed by thermal processing, the polymeric binder or carrier may be any of the thermally processable polymers disclosed in U.S. Pat. Nos. 6,197,486, 6,207,361, 6,436,619, 6,465,140 and 6,566,033 and all incorporated herein by reference. Suitable classes of thermoplastic polymers preferred for this invention can include polymers of alpha-beta unsaturated monomers, polyesters, polyamides, polycarbonates, cellulosic esters, polyvinyl resins, polysulfonamides, polyethers, polyimides, polyurethanes, polyphenylenesulfides, polytetrafluoroethylene, polyacetals, polysulfonates, polyester ionomers, and polyolefin ionomers. Interpolymers and/or mixtures of these polymers can also be used. Illustrative of polymers of alpha-beta unsaturated monomers, which are suitable for use in this invention include polymers of ethylene, propylene, hexene, butene, octene, vinylalcohol, acrylonitrile, vinylidene halide, salts of acrylic acid, salts of methacrylic acid, tetrafluoroethylene, chlorotrifluoroethylene, vinyl chloride, and styrene. Interpolymers and/or mixtures of these aforementioned polymers can also be used in the present invention. Most preferred polymers from this category include copolymers of polyethylenes, polypropylenes, because of their cost and mechanical properties. Exemplary copolymers may include ethylene propylene copolymers, ethylene methacrylate (EMA), ethylene ethylacrylate (EEA), ethylene butylacrylate (EBA), ethylene acrylic acid (EAA) or polylethylene with epoxy functionality like, ethylene butyl acrylate glycidylmethylacrylate (EBAGMA), ethylene glycidylmethacrylate (EGMA) and other polyolefins and their copolymers grafted with maleic anhydride, glycidylmethacrylate.

The polymer matrix is preferred to be blends of polymers. The blends may be miscible blends or immiscible blends. Preferably, the matrix is composed of a major copolymer component, with one or more secondary minor polymer components. The minor components may be used, while keeping in mind of the rheology of the minor component phase in relation to major component phase. In one embodiment, the matrix resin of the tie layer can consist of blends of polyolefin copolymers. Also, the matrix resin can be made up of a blend of polypropylene homopolymer and acrylate copolymer of ethylene.

Preferably, the major copolymer component of the tie layer comprises at least 70 wt % of polyolefins or polyolefin copolymers. The preferred copolymers of ethylene have an acrylate content greater than or equal to 9% and, most preferably, the acrylate content is greater than 12 wt %. Increasing the acrylate content in the copolymer typically reduces crystallinity, melting point and the Vicat point or softening point (as determined by ASTM D1525) of the copolymer. It is necessary to optimize the amount of acrylate content so as to obtain required adhesion to the image receiving layer and the support and also such that the tie layer does not soften during the printing process and lose its adhesion characteristics to the DRL or the support. Hence, the acrylate content in the copolymer of ethylene should be less than 24 wt %, such that Vicat temperature of the copolymer is greater than 43° C. More preferably, the Vicat point of the copolymer is greater than 45° C. Some of the commercially available copolymers or grafted (functionalized) polymers of ethylene that can be used as the matrix resin are DOW Chemical's Amplify grade of resins, Exxon Mobil Chemical Optema grade of resins, Dupont's Elvaloy, Elvaloy AC, Fusabond, Bynel, and Arkema's Lotader grade of resins. Preferred wt % of the total matrix resin is 80 wt %.

Preferred secondary polymer components may include polypropylene, and polyester, for example. Preferably, the polypropylene (PP) is used in a blend of ethylene copolymer, such as ethylene methyl acrylate or ethylene ethyl acrylate. The amount of secondary polymer used as part of the matrix polymer is less than or equal to 50 weight %, preferably less than 30 weight %. The amount of polypropylene that may be used is less than or equal to 15 wt %. If polypropylene is used, preferably the weight % of the polypropylene homopolymer is chosen such that it satisfies the following equation $$\phi_3 < \phi_1\left(\frac{\eta_3}{\eta_1}\right) \tag{1}$$

wherein $\eta_1$ and $\eta_3$ are, respectively, the melt viscosity at the same shear rate and temperature of the acrylate copolymer of ethylene and polypropylene homopolymer, and $\phi_1$ and $\phi_3$ are their respective volume fractions of the resins. By satisfying equation 1, total encapsulation of acrylate copolymer of ethylene by the polypropylene homopolymer is prevented.

The tie layer of the present invention also contains an antistatic material. This antistatic material may be humidity sensitive or insensitive. The amount of antistatic material contained in the tie layer is such that it provides the required static protection while absorbing/taking up/picking up less than 3 weight % of the antistatic material weight as moisture at 80% RH and 22.78° C. (73° F.). More preferable would be a tie layer composition, which provides static protection while taking up less or equal to 2 weight % of its material weight as moisture at 80% RH and 22.78° C.

Polyether based polymeric antistats are suitable materials containing polyalkoxylated compounds, which are well known in the art for their excellent melt-processabilty while retaining their antistatic property and overall physical performance. These materials can include various polymeric substances containing polyether blocks such as polyethylene oxides, polypropylene oxides, polybutylene oxides, polytetramethylene oxides, polyoxyalkylene glycols such as polyoxyethylene glycol, polyoxypropylene glycol, polyoxytetramethylene glycol, the reaction products of polyalkoxylates with fatty acids, the reaction products of polyalkoxylates with fatty alcohols, the reaction products of polyalkoxylates with fatty acid esters of polyhydroxyl alcohols (for instance polyalkoxylate reaction products of fatty acids, of fatty glycols, of fatty sorbitols, of fatty sorbitans, and of fatty alcohols), or, interpolymers and/or mixtures thereof. It is believed that ionic conduction along the polyether chains makes these polymers inherently dissipative, yielding surface resistivities in the range $10^8$-$10^{13}$ ohm/square. For the purpose of this invention any polyalkoxylated compounds containing oligomer, homopolymer, interpolymer and/or mixtures thereof can suitably be used in this invention. However, preferred examples of such polyether polymeric antistatic materials are: those comprising polyamide blocks and polyether block(s), e.g., as disclosed in U.S. Pat. Nos. 4,331,786, 4,115,475, 4,195,015, 4,839,441, 4,864,014, 4,230,838 and 4,332,920, U.S. Pat. No. 6,897,183 and U.S. Patent Publication No. 2004/0167020, all incorporated herein by reference, and product literature for Pebax supplied by Arkema, and PELESTAT® supplied by Sanyo Chemical Industries and Tomen America; polyetheresteramides, e.g., as disclosed in U.S. Pat. Nos. 5,604,284; 5,652,326; 5,886,098, incorporated herein by reference; thermoplastic polyurethanes containing a polyalkylene glycol moiety, e.g., as disclosed in U.S. Pat. Nos. 5,159,053; 5,863,466, incorporated herein by reference, with the content of all of the aforementioned literature incorporated herein by reference. Most preferred polyether polymeric antistats are those comprising polyolefin blocks and polyether block(s) like polypropylene block(s) with polyether block(s) or polyethylene block(s) with polyether block(s). These types of polyether antistatic polymers have been shown to be fairly thermally stable and readily processable in the melt state in their neat form or in blends with other polymeric materials.

A preferred antistatic polymer suitable for this invention is a block polymer which has a structure such that blocks of a polyolefin and blocks of a hydrophilic thermoplastic polymer are bonded together alternately and repeatedly. Preferably, the blocks of the hydrophilic thermoplastic polymer are polyether blocks. The polyether blocks can be formed from one or more alkylene oxides having 2 to 4 carbon atoms. The polyether blocks can comprise ethylene oxide, propylene oxide, or butylene oxide, or combinations thereof, preferably comprising at least 50 mole % ethylene oxide in the polyoxyalkylene chains. Typically, the polyolefins are obtained by polymerization of one or a mixture of two or more olefins containing 2 to 30 carbon atoms, preferably containing 2 to 12 carbon atoms, particularly preferably propylene and/or ethylene. Alternatively, low molecular weight polyolefins can be obtained by thermal degradation of high molecular weight olefins. The number average molecular weight of the polyolefin is preferably 800 to 20,000.

In one embodiment, the antistatic polymer is a block polymer having a structure such that the polyolefin block and the polyether block are bonded together alternately and repeatedly such that the polymers have a repeating unit represented by the following general formula (1).

$$[X-(\underset{\underset{R^1}{|}}{CH}-\underset{\underset{R^2}{|}}{CH})_y-X'-(OA)_m-O-E-O-(AO)_{m'})]_n- \tag{I}$$

In the general formula (I), n is an integer of 2 to 50, one of $R^1$ and $R^2$ is a hydrogen atom and the other is a hydrogen atom or an alkyl group containing 1 to 10 carbon atoms, y is an integer of 15 to 800, E is the residue of a diol after removal of the hydroxyl groups, A is an alkylene group containing 2 to 4 carbon atoms, m and m' each represents an integer of 1 to 300, X and X' are connecting groups used in the synthesis of the block polymer as listed in U.S. Pat. No. 6,552,131 (EP 1167425 A1), incorporated herein by reference in its entirety.

Such a block copolymer can be formed by the reaction of a mixture comprising a modified polyether and a modified polyolefin. For example, one or more polyether reactants such as polyether diols can be reacted with polyolefin reactants (obtained by modifying the termini of the polyolefin with carbonyl-containing groups or the like) and a polycondensation polymerization reaction carried out generally at 200 to 250° C. under reduced pressure employing known catalysts such as zirconium acetate.

Preferably, the antistat polymer comprises a block copolymer of polyethylene oxide (polyether) segments with a polypropylene and/or polyethylene (polyolefin) segments. In one embodiment, the block polymer has a number average molecular weight of 2,000 to 200,000 as determined by gel permeation chromatography. The polyolefin of the block polymer may have carbonyl groups at both polymer termini and/or a carbonyl group at one polymer terminus.

In the case of antistatic polymers comprising polyamide block(s) and polyether block(s), they are typically prepared using copolycondensation of polyamide sequences containing reactive ends with polyether sequences containing reactive ends, such as, inter alia: 1) Polyamide sequences containing diamine chain ends with polyoxylakylene sequences containing dicarboxyl chain ends, 2) Polyamide sequences containing dicarboxyl chain ends with polyoxyalkylene sequences containing diamine chain ends obtained by cyanoethylation and hydrogenation of alpha.,.omega.-dihydroxylated aliphatic polyoxylakylene sequences known as polyetherdiols, 3) Polyamide sequences containing dicarboxyl chain ends with polyetherdiols, the products obtained being, in this specific case, polyetheresteramides.

The polyamide sequences containing dicarboxyl chain ends result, for example, from the condensation of alpha., .omega.-aminocarboxylic acids from lactams or of dicarboxylic acids and diamines in the presence of a chain-limiting dicarboxylic acid. The polyamide blocks are advantageously formed from polyamide-6/12.

The number-average molecular mass or weight Mn of the polyamide sequences is between 300 and 15,000 and preferably between 600 and 5,000. The Mn of the polyether sequences is between 100 and 6,000 and preferably between 200 and 3,000.

The polymers containing polyamide blocks and polyether blocks can also comprise units distributed randomly. These polymers can be prepared by the simultaneous reaction of the polyether and the precursors of the polyamide blocks.

Whether the polyether blocks derive from polyethylene glycol, from polypropylene glycol or from polytetramethylene glycol, they are either used as they are and copolycondensed with polyamide blocks containing carboxyl ends or they are animated in order to be converted to polyetherdiamines and condensed with polyamide blocks containing carboxyl ends. They can also be mixed with polyamide precursors and a chain limiter in order to prepare polymers containing polyamide blocks and polyether blocks having units distributed statistically.

The polyether can be, for example, a polyethylene glycol (PEG), a polypropylene glycol (PPG) or a polytetramethylene glycol (PTMG). The latter is also known as polytetrahydrofuran (PTHF).

Whether the polyether blocks are introduced into the chain of the polymer containing polyamide blocks and polyether blocks in the form of diols or diamines, they are known for simplicity as PEG blocks or PPG blocks or alternatively PTMG blocks. It would not be departing from the scope of the invention if the polyether blocks contained different units, such as units derived from ethylene glycol, from propylene glycol or alternatively from tetramethylene glycol.

The polyamide blocks typically comprise condensation product of: one or a number of amino acids, such as aminocaproic, 7-aminoheptanoic, 11-aminoundecanoic and 12-aminododecanoic acids, or one or a number of lactams, such as caprolactam, oenantholactam and lauryllactam; one or a number of salts or mixtures of diamines, such as hexamethylenediamine, dodecamethylenediamine, meta-xylylenediamine, bis-(p-aminocyclohexyl)methane and trimethylhexamethylene-diamine, with diacids, such as isophthalic, terephthalic, adipic, azelaic, suberic, sebacic and dodecanedicarboxylic acids; or mixtures of some of these monomers, which result in copolyamides, for example polyamide-6/12 (or nylon-6/12) by condensation of caprolactam and lauryllactam. Polyamide mixtures can be used.

Preferably, the polymer having polyamide blocks and polyether blocks comprises a single type of block. Advantageously, polymers having polyamide-12 blocks and PEG blocks, and polymers having polyamide-6 blocks and PEG blocks are employed. One can however also employ blends of polymers having polyamide blocks and polyether blocks.

For the present invention, a polyolefin-polyether copolymer, such as PELESTAT® 300 and PELESTAT® 230, is the preferred antistatic material. Preferably, the antistatic material has a content of up to 30 wt % of the tie layer, more preferably up to 20 wt % of the tie layer. Preferably the weight % of the antistatic material is chosen such that it satisfies the following equation $$\phi_2 < \phi_1\left(\frac{\eta_2}{\eta_1}\right) \tag{2}$$

wherein $\eta_1$ and $\eta_2$ are, respectively, the melt viscosity (at the same shear rate and temperature) of the matrix polymer and antistatic polymer, and $\phi_1$ and $\phi_2$ are their respective volume fractions, wherein the sum is equal to one. Furthermore, the rheology of the matrix polymer is such that it is the continuous phase and acts as the adhesive to polymer laminate support, and the dye receiving layer (DRL). The overall tie layer composition needs to satisfy the criteria the sum of $\phi_1$, $\phi_2$, and $\phi_3$ is equal to one. Furthermore, the amount of antistatic material is chosen to satisfy a constraint that the tie layer does not absorb/take-up more than 3 weight % of its weight as moisture at 80% RH and 22.78° C. More preferable would be a tie layer composition which satisfies the above constraint, and provides static protection while taking up less or equal to 2 weight % of its material weight as moisture at 80% RH and 22.78° C. (73 F).

The antistatic layer of the invention may include other optional components. Such optional components may include compatibilizers, nucleating agents, fillers, plasticizers, impact modifiers, chain extenders, colorants, lubricants, surfactants and coating aids, other antistatic conductive agents, onium salts, pigments such as titanium oxide, zinc oxide, talc, calcium carbonate, barium sulfate, clay, dispersants such as fatty amides, (for example, stearamide), metallic salts of fatty acids, for example, zinc stearate, magnesium stearate, calcium stearate, dyes such as ultramarine blue, cobalt violet, antioxidants, fluorescent whiteners, ultraviolet absorbers, fire retardants, matte particles or roughening agents, such as silica, titanium dioxide, talc, barium sulfate, clay, and alumina, cross linking agents, solvents and cosolvents, and voiding agents. These optional components and appropriate amounts are well known in the art and can be chosen according to need.

Any compatibilizer, which can ensure compatibility between the polyether polymeric antistatic material and the extrudable polymer by way of controlling phase separation and polymer domain size, can be employed. Some exemplary compatibilizers are described in U.S. Pat. No. 6,436,619, incorporated herein by reference, to Majumdar et al. hereby incorporated by reference. Some examples of compatibilizers are: polyethylene, polypropylene, ethylene/propylene copolymers, ethylene/butene copolymers, all these products being grafted with maleic anhydride or gycidyl methacrylate; ethylene/alkyl(meth)acrylate/maleic anhydride copolymers, the maleic anhydride being grafted or copolymerized; ethylene/vinyl acetate/maleic anhydride copolymers, the maleic anhydride being grafted or copolymerized; the two above copolymers in which anhydride is replaced fully or partly by glycidyl methacrylate; ethylene/(meth)acrylic acid copolymers and optionally their salts; ethylene/alkyl(meth)acrylate/glycidyl methacrylate copolymers, the glycidyl methacrylate being grafted or copolymerized, grafted copolymers constituted by at least one mono-amino oligomer of polyamide and of an alpha-mono-olefin (co)polymer grafted with a monomer able to react with the amino functions of said oligomer. Such compatibilizers are described in, among others, EP-A-0,342,066 and EP-A-0,218,665, incorporated herein by reference, which are also incorporated herein by reference. Some preferred compatibilizers are terpolymers of ethylene/methyl acrylate/glycidyl methacrylate and copolymers of ethylene/glycidyl methacrylate, commercially available as Lotader from Arkema or similar products. Preferred compatibilizers also include maleic anhydride grafted or copolymerized polyolefins such as polypropylene, polyethylene, etc., commercially available as Orevac from Arkema or similar products.

Furthermore, the rheology of the copolymer is such that it is the continuous phase and acts as the adhesive between adjacent polymer layers and the dye receiving layer (DRL).

The adhesion of these tie layers may be further enhanced using an infrared (IR) heat treatment, where the image receiving layer or dye receiving layer (DRL) surface is exposed to IR heat during manufacturing or finishing. The improvement in adhesion after IR heat is dependent on surface temperature and time spent under IR heat. The optimum surface temperature of the DRL needs to be between 93° C.-109° C. (200-228° F.). The time spent under IR heat is a function of line speeds of the manufacturing or the finishing operation and should be around 1 sec. The time and temperature that the image receiving layer or the DRL is exposed to IR needs to be adjusted such that no blistering of the DRL surface occurs.

According to one embodiment of the invention, the antistatic tie layer and the outer layer (image receiving layer or dye-receiving layer) can be coextruded as follows. In a first step, a first melt and a second melt are formed, the first melt of a polymer being for an outer layer (or dye-image receiving layer) and the second melt comprising a thermoplastic polymer blend having desirable antistatic, adhesive, viscoelastic properties, preferably having not more than 10 times or 1/10, preferably not more than 3 times or less than 1/3 difference in viscosity from that of the first melt that forms the outer layer (or dye-receiving layer), thereby promoting efficient and high quality coextrusion. The tie layer, and its melt, preferably comprises a polymeric binder or matrix resin for the antistatic polymer. The tie layer components are adjusted to obtain the desired viscoelastic properties of the tie-layer melt (while maintaining desired product requirements), so that when extruded, the film does not extend beyond the edges of the coextruded film from the melt for the image-receiving layer, resulting in unmatched films. In such an event, a portion of an unmatched extruded film may be trimmed off. However, this reduces, although not eliminating, the favorable economics for extrusion versus solvent coating. Unmatched edges between coextruded films may tend to occur when the viscosity ratio between coextruded melts is about 10:1. In a second step, the two melts are coextruded using a coextrusion feedblock or a multimanifold die technology. In a third step, the coextruded layers or laminate is stretched to reduce the thickness. In a fourth step, the extruded and stretched melt is applied to a support for the image recording element or dye-receiving element while simultaneously reducing the temperature within the range below the glass transition temperature ($T_g$) of the image receiving layer or dye receiving layer, for example, by quenching between two nip rollers. In a preferred embodiment, the support is a polyolefin-containing support. The ratio of thickness of the tie layer to the image receiving layer or DRL after coating and quenching on the support is typically 1:1 to 1:10, preferred in 1:2 to 1:5.

The particular structure of a dye-receiver element made according to the present invention can vary, but is generally a multilayer structure comprising, under the dye-image receiving layer, a support (defined as all layers below the dye-image receiving layer, not including any tie layer immediately adjacent the dye-image receiving layer) that comprises a composite compliant film, preferably comprising a microvoided layer, and (under the compliant film) a base support, preferably comprising a cellulose paper or resin coated paper.

The support for use in the present invention may be any support typically used in imaging applications. Any of the embodiments of this invention could further be laminated to a substrate or support to increase the utility of the imaging element. Typical supports may be fabrics, paper, and polymer sheets. The preferred support is a voided multilayered biaxially oriented polypropylene (BOPP) film like those offered by Exxon Mobil that is laminated to a paper raw base which is also laminated to another biaxially oriented polypropylene (BOPP) film on the side opposite to the image receiving layer.

The preferred laminate support may be a multilayer support with a skin surface or layers. In one preferred embodiment, different skin surfaces are used on the faceside, that is, the top surface of the top layer of the laminate on the side bearing the imaging layers, of the polymer laminate support, along with the tie layer or layers, such as copolymers of ethylene, like ethylene methyl acrylate (EMA) or ethylene ethyl acrylate (EEA) or ethylene methyl acrylate with maleic anhydride. In another embodiment, the skin surface of the faceside laminate may be polyethylene or copolymer of ethylene, such as EMA, EEA, EBA) or functionalized or grafted ethylene polymers. The acrylate content in the skin should be so adjusted that it does not block in roll form. Preferred would be less than 24 wt % of the acrylate content in the skin.

The support may be either transparent or opaque, reflective or non-reflective. Opaque supports include plain paper, coated paper, resin-coated paper such as polyolefin-coated paper, synthetic paper, low density foam core based support, low density foam core based paper, photographic paper support, melt-extrusion-coated paper, and polyolefin-laminated paper. In a preferred embodiment, the support comprises a support for an imaging element, which has an opacity of greater than 60. In one preferred embodiment, the supports preferably comprise opaque and/or transparent film-based output and capture supports.

The papers include a broad range of papers, from high end papers, such as photographic paper to low end papers, such as newsprint. In a preferred embodiment, Ektacolor paper made by Eastman Kodak Co. as described in U.S. Pat. Nos. 5,288,690 and 5,250,496, incorporated herein by reference, incorporated herein by reference, may be employed. The support may comprise a cast support, a sequentially cast support or a coextruded support.

Biaxially oriented supports include a paper base and a biaxially oriented polyolefin sheet, typically polypropylene, laminated to one or both sides of the paper base. Commercially available oriented and unoriented polymer films, such as opaque biaxially oriented polypropylene or polyester, may also be utilized. Such supports may contain pigments, air voids or foam voids to enhance their opacity. The support may also consist of microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861, incorporated herein by reference. Microvoided composite biaxially oriented sheets may be utilized and are conveniently manufactured by coextrusion of the core and surface layers, followed by biaxial orientation, whereby voids are formed around void-initiating material contained in the core layer. Such composite sheets are disclosed in, for example, U.S. Pat. Nos. 4,377,616; 4,758,462 and 4,632,869, the disclosures of which is incorporated for reference.

"Void" is used herein to mean devoid of added solid and liquid matter, although it is likely the "voids" contain gas. The void-initiating particles, which remain in the finished packaging sheet core, should be from 0.1 to 10 microns in diameter and preferably round in shape to produce voids of the desired shape and size. The size of the void is also dependent on the degree of orientation in the machine and transverse directions. Ideally, the void would assume a shape that is defined by two opposed, and edge contacting, concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid may traverse.

Biaxially oriented sheets, while described as having preferably at least one layer, may also be provided with additional layers that may serve to change the properties of the biaxially oriented sheet. Such layers might contain tints, antistatic or conductive materials, or slip agents to produce sheets of unique properties. Biaxially oriented sheets may be formed with surface layers, referred to herein as skin layers, which would provide an improved adhesion, or look to the support and photographic element. The biaxially oriented extrusion may be carried out with as many as 10 layers if desired to achieve some particular desired property. The biaxially oriented sheet may be made with layers of the same polymeric material, or it may be made with layers of different polymeric composition. For compatibility, an auxiliary layer may be used to promote adhesion of multiple layers.

Transparent supports include glass, cellulose derivatives, such as a cellulose ester, cellulose triacetate, cellulose diacetate, cellulose acetate propionate, cellulose acetate butyrate, polyesters, such as poly(ethylene terephthalate), poly(ethylene naphthalate), poly-1,4-cyclohexanedimethylene terephthalate, poly(butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The term as used herein, "transparent" means the ability to pass visible radiation without significant deviation or absorption. In a preferred embodiment, the element has a % transmission of greater than 80%.

The imaging element support used in the invention may have a thickness of from 50 to 500 μm, preferably from 75 to 350 μm. Antioxidants, brightening agents, antistatic or conductive agents, plasticizers and other known additives may be incorporated into the support, if desired. In one preferred embodiment, the element has an L*UVO (UV out) of greater than 80 and a b*UVO of from 0 to −6.0. L*, a* and b* are CIE parameters (see, for example, Appendix A in Digital Color Management by Giorgianni and Madden, published by Addison, Wesley, Longman Inc., 1997) that can be measured using a Hunter Spectrophotometer using the D65 procedure. UV out (UVO) refers to use of UV filter during characterization such that there is no effect of UV light excitation of the sample.

The tie layer promotes adhesion, and may be applied to either the flange sheets or the core prior to their being brought into a nip. In a preferred form, the adhesive tie layer is applied into the nip simultaneously with the flange sheets and the core. The support may comprise a core, for example, paper, that has adhered thereto at least one flange layer. The paper may come from a broad range of papers, from high end papers, such as photographic paper to low end papers, such as newsprint. In a preferred embodiment, photographic paper is employed. The paper may be made on a standard continuous fourdrinier wire machine or on other modern paper formers. Any pulps known in the art to provide paper may be used in this invention. Bleached hardwood chemical kraft pulp is preferred, as it provides brightness, a smooth starting surface, and good formation while maintaining strength. Paper cores useful to this invention are of caliper from 50 μm to 230 μm, preferably from 100 μm to 190 μm because then the overall element thickness is in the range preferred by customers for imaging element and processes in existing equipment. They may be "smooth" as to not interfere with the viewing of images. Chemical additives to impart hydrophobicity (sizing), wet strength, and dry strength may be used as needed. Inorganic filler materials such as $TiO_2$, talc, mica, $BaSO_4$ and $CaCO_3$ clays may be used to enhance optical properties and reduce cost as needed. Dyes, biocides, and processing chemicals may also be used as needed. The paper may also be subject to smoothing operations such as dry or wet calendering, as well as to coating through an in-line or an off-line paper coater.

In another embodiment, the support comprises a synthetic paper, preferably cellulose-free, having a polymer core that has adhered thereto at least one flange layer. The polymer core comprises a homopolymer such as a polyolefin, polystyrene, polyester, polyvinylchloride or other typical thermoplastic polymers; their copolymers or their blends thereof; or other polymeric systems like polyurethanes, polyisocyanurates. These materials may or may not have been expanded either through stretching resulting in voids or through the use of a blowing agent to consist of two phases, a solid polymer matrix, and a gaseous phase. Other solid phases may be present in the form of fillers that are of organic (polymeric, fibrous) or inorganic (glass, ceramic, metal) origin. The fillers may be used for physical, optical (lightness, whiteness, and opacity), chemical, or processing property enhancements of the core.

In another embodiment, the support comprises a synthetic paper, preferably cellulose-free, having a foamed polymer core or a foamed polymer core that has adhered thereto at least one flange layer. The polymers described for use in a polymer core may also be employed in manufacture of the foamed polymer core layer, carried out through several mechanical, chemical, or physical means. Mechanical methods include whipping a gas into a polymer melt, solution, or suspension, which then hardens either by catalytic action or heat or both, thus entrapping the gas bubbles in the matrix. Chemical methods include such techniques as the thermal decomposition of chemical blowing agents generating gases such as nitrogen or carbon dioxide by the application of heat or through exothermic heat of reaction during polymerization. Physical methods include such techniques as the expansion of a gas dissolved in a polymer mass upon reduction of system pressure; the volatilization of low-boiling liquids such as fluorocarbons or methylene chloride, or the incorporation of hollow microspheres in a polymer matrix. The choice of foaming technique is dictated by desired foam density reduction, desired properties, and manufacturing process. Preferably, the foamed polymer core comprises a polymer expanded through the use of a blowing agent.

In a preferred embodiment of this invention polyolefins such as polyethylene and polypropylene, their blends and their copolymers are used as the matrix polymer in the foamed polymer core along with a chemical blowing agent such as sodium bicarbonate and its mixture with citric acid, organic acid salts, azodicarbonamide, azobisformamide, azobisisobutyrolnitrile, diazoaminobenzene, 4,4'-oxybis(benzene sulfonyl hydrazide) (OBSH), N,N'-dinitrosopentamethyltetramine (DNPA), sodium borohydride, and other blowing agent agents well known in the art. The preferred chemical blowing agents would be sodium bicarbonate/citric acid mixtures, azodicarbonamide; though others may also be used. These foaming agents may be used together with an auxiliary foaming agent, nucleating agent, and a cross-linking agent.

The flange layers may also include other additives. These may include filler materials such as titanium dioxide and calcium carbonate and colorants, pigments, dyes and/or optical brighteners or other additives known to those skilled in the art. Some of the commonly used inorganic filler materials are talc, clays, calcium carbonate, magnesium carbonate, barium sulfate, mica, aluminum hydroxide (trihydrate), wollastonite, glass fibers and spheres, silica, various silicates, and carbon black. Some of the organic fillers used are wood flour, jute fibers, sisal fibers, or polyester fibers. The preferred fillers are talc, mica, and calcium carbonate because they provide excellent modulus enhancing properties. The fillers may be in the flange or an overcoat layer, such as polyethylene. Generally, base materials for color print imaging materials are white, possibly with a blue tint as a slight blue is preferred to form a preferred white look to whites in an image. Any suitable white pigment may be incorporated in the support such as, for example, titanium dioxide, zinc oxide, zinc sulfide, zirconium dioxide, white lead, lead sulfate, lead chloride, lead aluminate, lead phthalate, antimony trioxide, white bismuth, tin oxide, white manganese, white tungsten, and combinations thereof. The preferred pigment is titanium dioxide. In addition, suitable optical brightener may be employed in the polyolefin layer including those described in *Research Disclosure*, Vol. No. 308, December 1989, Publication 308119, Paragraph V, page 998.

In addition, it may be desirable to use various additives such as antioxidants, stiffness enhancing agents, slip agents, or lubricants, and light stabilizers in the synthetic elements, especially synthetic plastic elements, as well as biocides in the paper elements. These additives are added to improve, among other things, the dispersibility of fillers and/or colorants, as well as the thermal and color stability during processing and the manufacturability and the longevity of the finished article. For example, polyolefin coatings may contain antioxidants such as 4,4'-butylidene-bis(6-tert-butyl-meta-cresol), di-lauryl-3,3'-thiopropionate, N-butylated-p-aminophenol, 2,6-di-tert-butyl-p-cresol, 2,2-di-tert-butyl-4-methyl-phenol, N,N-disalicylidene-1,2-diaminopropane, tetra(2,4-tert-butylphenyl)-4,4'-diphenyl diphosphonite, octadecyl 3-(3',5'-di-tert-butyl-4-hydroxyphenyl propionate), combinations of the above, lubricants, such as higher aliphatic acid metal salts such as magnesium stearate, calcium stearate, zinc stearate, aluminum stearate, calcium palmitate, zirconium octylate, sodium laurate, and salts of benzoic acid such as sodium benzoate, calcium benzoate, magnesium benzoate and zinc benzoate; light stabilizers such as hindered amine light stabilizers (HALS), of which a preferred example is poly{[6-[(1,1,3,3-tetramethylbutylamino}-1,3,5-triazine-4-piperidinyl)-imino]-1,6-hexanediyl[{2,2,6,6-tetramethyl-4-piperdinyl)imino]} (Chimassorb® 944 LD/FL), 7-Oxa-3,20-diazadispiro[5.1.11.2]heneicosan-21-one, 2,2,4,4-tetramethyl-20-(oxiranylmethyl)-, homopolymer (Hostavin® N30).

The imaging support, while described as having at least two or three layers, may also be provided with additional layers that may serve to change the properties of the support. These might include layers to provide a vapor barrier, to improve opacity, to control color or static, to make them heat sealable, or to improve the adhesion to the support or to the photosensitive layers. Examples of this would be coating polyvinylidene chloride for heat seal properties. Further examples include flame, plasma, or corona discharge treatment to improve printability or adhesion.

Most preferably, the tie layer is used with a coextruded dye receiving layer (DRL).

A preferred embodiment of the invention is directed to a method of making a dye-receiving element for thermal dye transfer comprising a support and on one side thereof a dye image-receiving layer, wherein between the dye-image receiving layer and the support is a tie layer that was made by coextrusion with at least the dye-receiving layer, wherein the composition of the tie layer comprises a polyolefin-containing binder and a thermoplastic antistatic polymer having preselected antistat, adhesive, and viscoelastic properties as described above. The total thickness of said dye-receiving layer in the final product is less than 10 microns, preferably 1 to 5 microns thick; the thickness of the tie layer is also preferably not more than 10 microns, preferably 0.75 to 5 microns thick.

Used herein, the phrase 'imaging element' comprises an imaging support along with at least one image receiving layer as applicable to multiple techniques governing the transfer of an image onto the imaging element. Such techniques include thermal dye transfer, electrophotographic printing, or inkjet printing, as well as a support for photographic silver halide images. As used herein, the phrase "photographic element" is a material that utilizes photosensitive silver halide in the formation of images. An embodiment of this invention may contain silver halide, inkjet receiving layers, thermal dye receiving layers or electrophotographic layers or combinations thereof. The elements may include those intended for reflection viewing, which usually have an opaque support, and those intended for viewing by transmitted light, which usually have a transparent support.

The image receiving layer of the present invention may comprise a thermal image receiving layer, preferably as disclosed in U.S. Pat. No. 7,091,157, incorporated herein by reference. The thermal ink or dye image-receiving or recording layer of the receiving or recording elements used with the invention may comprise, for example, a polycarbonate, a polyurethane, a polyester, polyvinyl chloride, poly(styrene-co-acrylonitrile), poly(caprolactone), or mixtures thereof. The ink or dye image-receiving or recording layer may be present in any amount that may be effective for the intended purpose. An overcoat layer may be further coated over the ink or dye-receiving or recording layer, such as described in U.S. Pat. No. 4,775,657 of Harrison et al.

Ink or dye-donor elements that may be used with the ink or dye-receiving or recording element used with the invention conventionally comprise a support having thereon an ink or dye containing layer.

Any ink or dye may be used in the ink or dye-donor employed in the invention, provided it is transferable to the ink or dye-receiving or recording layer by the action of heat. Ink or dye donors applicable for use in the present invention are described, for example, in U.S. Pat. Nos. 4,916,112; 4,927,803; and 5,023,228, all incorporated herein by reference. As noted above, ink or dye-donor elements may be used to form an ink or dye transfer image. Such a process comprises image-wise-heating an ink or dye-donor element and transferring an ink or dye image to an ink or dye-receiving or recording element as described above to form the ink or dye transfer image. The thermal ink or dye transfer method of printing, an ink or dye donor element may be employed which comprises a poly(ethylene terephthalate) support coated with sequential repeating areas of cyan, magenta, and yellow ink or dye, and the ink or dye transfer steps may be sequentially performed for each color to obtain a three-color ink or dye transfer image. When the process is only performed for a single color, then a monochrome ink or dye transfer image may be obtained.

Dye-donor elements that may be used with the dye-receiving element used in the invention conventionally comprise a support having thereon a dye containing layer. Any dye can be used in the dye layer of the dye-donor element of the invention provided it is transferable to the dye-receiving layer by the action of heat. Especially good results have been obtained with sublimable dyes, especially dyes referred to in U.S. Pat. No. 7,160,664, incorporated herein by reference in its entirety.

The magenta dye combinations as described in U.S. Pat. No. 7,160,664, incorporated herein by reference, can be used in a dye-donor layer of a thermal dye-donor element to form images by thermal printing. The dye-donor layer can include the magenta dye combination alone, or multiple colored areas (patches) containing dyes suitable for thermal printing. As used herein, a "dye" can be one or more dye, pigment, colorant, or a combination thereof, and can optionally be in a binder or carrier as known to practitioners in the art. For example, the dye layer can include the magenta dye combination and further comprise a yellow dye-donor patch comprising at least one bis-pyrazolone-methine dye and at least one other pyrazolone-methine dye, and a cyan dye-donor patch comprising at least one indoaniline cyan dye.

Any dye transferable by heat can be used in the dye-donor layer of the dye-donor element. The dye can be selected by taking into consideration hue, lightfastness, and solubility of the dye in the dye donor layer binder and the dye image receiving layer binder. Suitable magenta dye combinations are discussed above.

Examples of suitable dyes include anthraquinone dyes, e.g., Sumikalon Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumickaron Diazo Black 5G® (Sumitomo Chemical Co., Ltd.), and Miktazol Black 5 GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumicacryl Blue 6G® (Sumitomo Chemical Co., Ltd.), and Aizen Malachite Green® (Hodogaya Chemical Co., Ltd.); or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

Examples of further suitable dyes, including further magenta, yellow, and cyan dyes, can include, but are not limited to, diarylmethane dyes; triarylmethane dyes; thiazole dyes, such as 5-arylisothiazole azo dyes; methine dyes such as merocyanine dyes, for example, aminopyrazolone merocyanine dyes; azomethine dyes such as indoaniline, acetophenoneazomethine, pyrazoloazomethine, imidazoleazomethine, imidazoazomethine, pyridoneazomethine, and tricyanopropene azomethine dyes; xanthene dyes; oxazine dyes; cyanomethylene dyes such as dicyanostyrene and tricyanostyrene dyes; thiazine dyes; azine dyes; acridine dyes; azo dyes such as benzeneazo, pyridoneazo, thiopheneazo, isothiazoleazo, pyrroleazo, pyrraleazo, imidazoleazo, thiadiazoleazo, triazoleazo, and disazo dyes; arylidene dyes such as alpha-cyano arylidene pyrazolone and aminopyrazolone arylidene dyes; spiropyran dyes; indolinospiropyran dyes; fluoran dyes; rhodaminelactam dyes; naphthoquinone dyes, such as 2-carbamoyl-4-[N-(p-substituted aminoaryl)imino]-1,4-naphthaquinone; anthraquinone dyes; and quinophthalone dyes. Specific examples of dyes usable herein can include:

C.I. (color index) Disperse Yellow 51, 3, 54, 79, 60, 23, 7, and 141;
C.I. Disperse Blue 24, 56, 14, 301, 334, 165, 19, 72, 87, 287, 154, 26, and 354;
C.I. Disperse Red 135, 146, 59, 1, 73, 60, and 167;
C.I. Disperse Orange 149;
C.I. Disperse Violet 4, 13, 36, 56, and 31;
C.I. Disperse Yellow 56, 14, 16, 29, and 231;
C.I. Solvent Blue 70, 35, 36, 50, 49, 111, 105, 97, and 11;
C.I. Solvent Red 135, 81, 18, 25, 19, 23, 24, 143, 146, and 182;
C.I. Solvent Violet 13;
C.I. Solvent Black 3; and
C.I. Solvent Green 3.

Further examples of sublimable or diffusible dyes that can be used include anthraquinone dyes, such as Sumikalon Violet RS® (product of Sumitomo Chemical Co., Ltd.), Dianix Fast Violet 3R-FS® (product of Mitsubishi Chemical Corporation.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5 GH® (product of Mitsui Toatsu Chemicals, Inc.); direct dyes such as Direct Dark Green B® (product of Mitsubishi Chemical Corporation) and Direct Brown M® and Direct Fast Black D® (products of Nippon Kayaku Co. Ltd.); acid dyes such as Kayanol Milling Cyanine 5R® (product of Nippon Kayaku Co. Ltd.); and basic dyes such as Sumicacryl Blue 6G® (product of Sumitomo Chemical Co., Ltd.), and Aizen Malachite Green® (product of Hodogaya Chemical Co., Ltd.).

Another preferred embodiment utilizes a cyan dye, alone or in combination, comprising at least a first cyan dye of the following structure XX:

(XX)

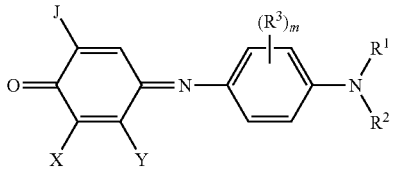

wherein: $R^1$ and $R^2$ each independently represents hydrogen; an alkyl group having from 1 to about 6 carbon atoms; a cycloalkyl group having from about 5 to about 7 carbon atoms; allyl; or such alkyl, cycloalkyl or allyl groups substituted with one or more groups such as alkyl, aryl, alkoxy, aryloxy, amino, halogen, nitro, cyano, thiocyano, hydroxy, acyloxy, acyl, alkoxycarbonyl, aminocarbonyl, alkoxycarbonyloxy, carbamoyloxy, acylamido, ureido, imido, alkylsulfonyl, arylsulfonyl, alkylsulfonamido, arylsulfonamido, alkylthio, arylthio, trifluoromethyl, etc., e.g., methyl, ethyl, propyl, isopropyl, butyl, pentyl, hexyl, methoxyethyl, benzyl, 2-methanesulfonamidoethyl, 2-hydroxyethyl, 2-cyanoethyl, methoxycarbonylmethyl, cyclohexyl, cyclopentyl, phenyl, pyridyl, naphthyl, thienyl, pyrazolyl, p-tolyl, p-chlorophenyl, m-(N-methyl-sulfamoyl) phenylmethyl, methylthio, butylthio, benzylthio, methanesulfonyl, pentanesulfonyl, methoxy, ethoxy, 2-methane-sulfonamidoethyl, 2-hydroxyethyl, 2-cyanoethyl, methoxy-carbonyl-methyl, imidazolyl, naphthyloxy, furyl, p-tolylsulfonyl, p-chlorophenylthio, m-(N-methyl sulfamoyl)phenoxy, ethoxycarbonyl, methoxyethoxycarbonyl, phenoxycarbonyl, acetyl, benzoyl, N,N-dimethylcarbamoyl, dimethylamino, morpholino, anilino, pyrrolidino etc.; each $R^3$ independently represents hydrogen, substituted or unsubstituted alkyl, cycloalkyl or allyl as described above for $R^1$ and $R^2$; alkoxy, aryloxy, halogen, thiocyano, acylamido, ureido, alkylsulfonamido, arylsulfonamido, alkylthio, arylthio or trifluoromethyl;

or any two of $R^3$ may be combined together to form a 5- or 6-membered carbocyclic or heterocyclic ring;

or one or two of $R^3$ may be combined with either or both of $R^1$ and $R^2$ to complete a 5- to 7-membered ring;

m is an integer of from 0 to 4;

X represents hydrogen, halogen or may be combined together with Y to represent the atoms necessary to complete a 6-membered aromatic ring, thus forming a fused bicyclic quinoneimine, such as a naphthoquinoneimine;

J represents $NHCOR^4$, $NHCO_2R^4$, $NHCONHR^4$ or $NHSO_2R^4$; and with the proviso that when X is combined with Y, then J represents $CONHR^4$, $SO_2NHR^4$, CN, $SO_2R^4$ or SCN, in which case, however, $R^4$ cannot be hydrogen;

$R^4$ is the same as $R^1$ or represents an aryl group having from about 6 to about 10 carbon atoms; a hetaryl group having from about 5 to about 10 atoms; or such aryl or hetaryl groups substituted with one or more groups such as are listed above for $R^1$ and $R^2$; and Y is the same as $R^4$, or acylamino or may be combined together with X as described above.

Other suitable cyan dyes can include Kayaset Blue 714 (Solvent Blue 63, manufactured by Nippon Kayaku Co., Ltd.), Phorone Brilliant Blue S-R (Disperse Blue 354, manufactured by Sandoz K.K.), Solvent Blue 63, and cyan dyes of the structures:

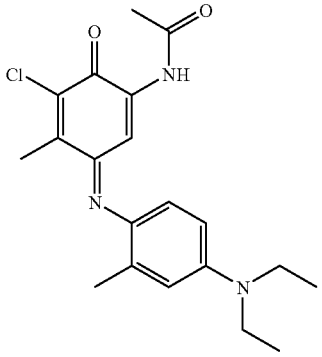

-continued

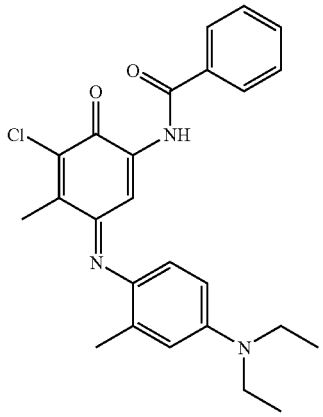

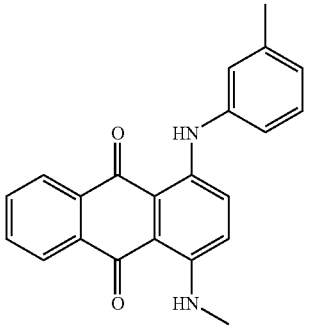

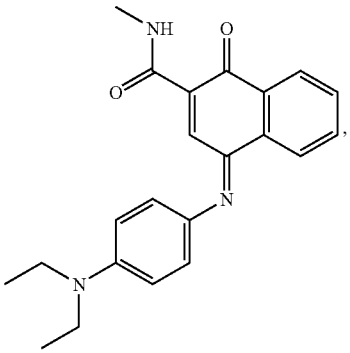

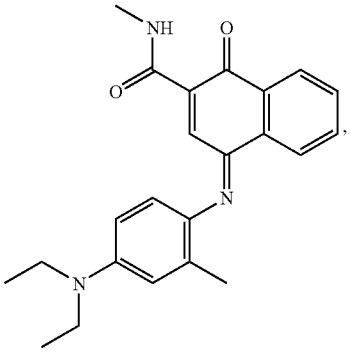

-continued

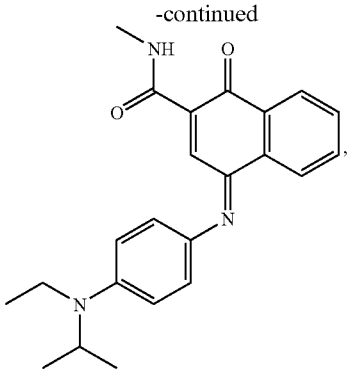

, and

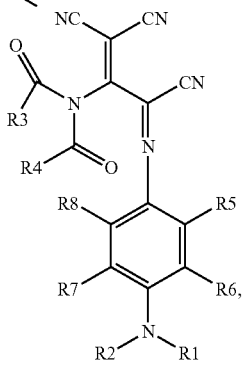

where R1 and R2 each independently represents an alkyl group, a cycloalkyl group, an aryl group, a heterocyclic group, or R1 and R2 together represent the necessary atoms to close a heterocyclic ring, or R1 and/or R2 together with R6 and/or R7 represent the necessary atoms to close a heterocyclic ring fused on the benzene ring; R3 and R4 each independently represents an alkyl group, or an alkoxy group; R5, R6, R7 and R8 each independently represents hydrogen, an alkyl group, a cycloalkyl group, an aryl group, an alkoxy group, an aryloxy group, a carbonamido group, a sulfamido group, hydroxy, halogen, $NHSO_2R_9$, $NHCOR_9$, $OSO_2R_9$, or $OCOR_9$, or $R_5$ and $R_6$ together and/or $R_7$ and $R_8$ together represent the necessary atoms to close one or more heterocyclic ring fused on the benzene ring, or R6 and/or R7 together with R1 and/or R2 represent the necessary atoms to close a heterocyclic ring fused on the benzene ring; and R9 represents an alkyl group, a cycloalkyl group, an aryl group and a heterocyclic group.

Another preferred embodiment utilizes a yellow dye, alone or in combination, comprising at least a first yellow dye of the following structure X:

(X)

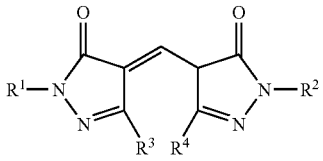

wherein $R^1$ and $R^2$ can be respectively independently selected and are a lower alkyl group which may be substituted, a lower alkenyl group which may be substituted or an aryl group which may be substituted; and $R^3$ and $R^4$ can be respectively independently selected and are a lower alkyl group which may be substituted, a dialkylamino group, a —$COOR^5$ group or a —$CONR^6R^7$ group, in which $R^5$ is a lower alkyl group which may be substituted, a lower alkenyl group which may be substituted or an aryl group which may be substituted and $R^6$ and $R^7$ can be respectively independently selected and are a hydrogen atom, a lower alkyl group which may be substituted, a lower alkenyl group which may be substituted or an aryl group which may be substituted.

A preferred yellow dye of structure X specifically has the following structure:

(Xa)

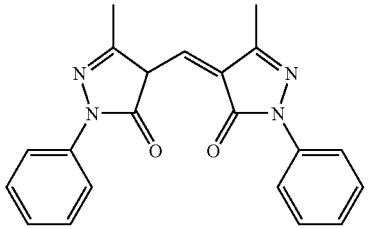

Another preferred embodiment utilizes a yellow dye, alone or in combination, comprising at least a first yellow dye of the following structure XI:

(XI)

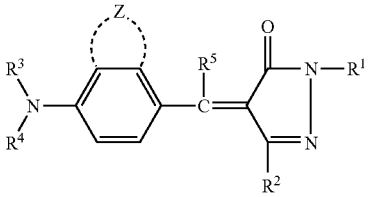

wherein $R^1$ represents a substituted or unsubstituted alkyl group having from 1 to about 10 carbon atoms; a cycloalkyl group having from about 5 to about 7 carbon atoms or an aryl group having from about 6 to about 10 carbon atoms;

$R^2$ represents a substituted or unsubstituted alkoxy group having from 1 to about 10 carbon atoms; a substituted or unsubstituted aryloxy group having from about 6 to about 10 carbon atoms; $NHR^6$; $NR^6R^7$ or the atoms necessary to complete a 6-membered ring fused to the benzene ring;

$R^3$ and $R^4$ each represents $R^1$; or $R^3$ and $R^4$ can be joined together to form, along with the nitrogen to which they are attached, a 5- or 6-membered hetercyclic ring;

$R^5$ represents hydrogen; halogen; carbamoyl; alkoxycarbonyl; acyl; a substituted or unsubstituted alkyl or alkoxy group having from 1 to about 10 carbon atoms; a cycloalkyl group having from about 5 to about 7 carbon atoms; an aryl group having from about 6 to about 10 carbon atoms; or a dialkylamino group;

$R^6$ and $R^7$ each independently represents a substituted or unsubstituted alkyl group having from 1 to about 10 carbon atoms; a cycloalkyl group having from about 5 to about 7 carbon atoms or an aryl group having from about 6 to about 10 carbon atoms; $R^6$ and $R^7$ may be joined together to form, along with the nitrogen to which they are attached, a 5- or 6-membered heterocyclic ring; and Z represents hydrogen or the atoms necessary to complete a 5- or 6-membered ring.

A preferred yellow dye of structure XI specifically has the following structure:

(XIa)

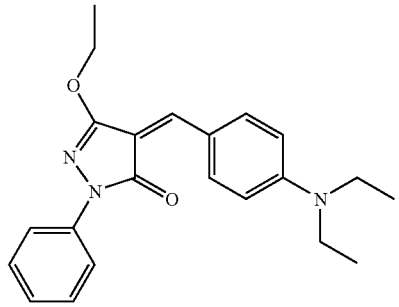

Another preferred embodiment utilizes a yellow dye, alone or in combination, comprising at least a first yellow dye of the following structure XII:

(XII)

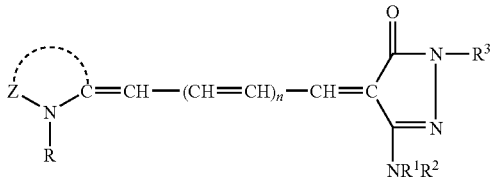

wherein: R represents a substituted or unsubstituted alkyl group of from 1 to about 6 carbon atoms or a substituted or unsubstituted aryl group of from about 6 to about 10 carbon atoms;

$R^1$ and $R^2$ each independently represents hydrogen, with the proviso that only one of $R^1$ and $R^2$ may be hydrogen at the same time; a substituted or unsubstituted alkyl group of from 1 to about 6 carbon atoms or a substituted or unsubstituted aryl group of from about 6 to about 10 carbon atoms; or $R^1$ and $R^2$ may be combined together with the nitrogen to which they are attached to form a heterocyclic ring system;

$R^3$ is R;

n represents 0 or 1; and

Z represents the atoms necessary to complete a 5- or 6-membered substituted or unsubstituted heterocyclic ring.

A preferred yellow dye of structure XII specifically has the following structure:

(XIIa)

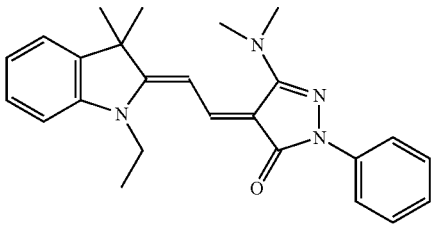

Another preferred embodiment utilizes a yellow dye, alone or in combination, comprising at least a first yellow dye of the following structure XIII:

(XIII)

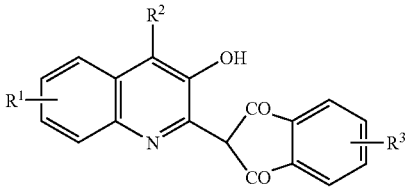

wherein $R_1$ is an alkyl group having 1 to 8 carbon atoms or cycloalkyl group;

$R_2$ is a hydrogen atom, halogen atom, alkoxy group which may be substituted, alkylthio group which may be substituted or arylthio group which may be substituted;

$R_3$ is a branched alkyl group having 3 to 5 carbon atoms, an O-substituted oxycarbonyl group, an N-substituted aminocarbonyl group in which the N-substituted group may form a ring, or a substituted or unsubstituted heterocyclic ring having two or more hetero atoms of one or more kinds selected from the group consisting of a nitrogen atom, oxygen atom and sulfur atom.

A preferred yellow dye of structure XIII specifically has the following structure:

(XIIIa)

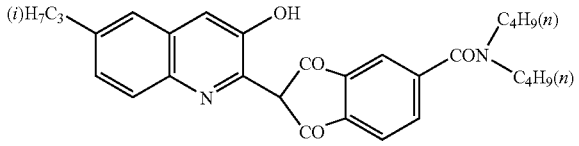

Other suitable yellow dyes can include Phorone Brilliant Yellow S-6 GL (Disperse Yellow 231, manufactured by Sandoz K.K.) and Macrolex Yellow 6G (Disperse Yellow 201, manufactured by Bayer), and yellow dye of the structures:

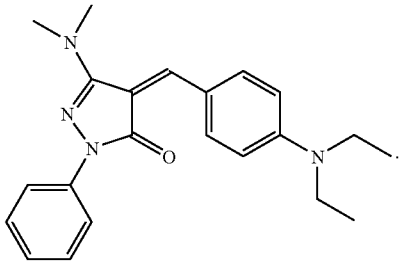

Further examples of useful dyes can be found in U.S. Pat. Nos. 4,541,830; 4,698,651; 4,695,287; 4,701,439; 4,757,046; 4,743,582; 4,769,360; 4,753,922; 4,910,187; 5,026,677; 5,101,035; 5,142,089; 5,374,601; 5,476,943; 5,532,202; 5,804,531; 6,265,345, and U.S. Patent Application Publication No. US 2003/0181331, the disclosures of which are hereby incorporated by reference.

The dyes can be employed singly or in combination to obtain a monochrome dye-donor layer or a black dye-donor layer. The dyes can be used in an amount of from 0.05 $g/m^2$ to 1 $g/m^2$ of coverage. According to various embodiments, the dyes can be hydrophobic.

As noted above, dye-donor elements may be used to form a dye transfer image. Such a process comprises imagewise-heating a dye-donor element and transferring a dye image to a dye-receiving element as described above to form the dye transfer image.

In a preferred embodiment of the invention, a dye-donor element may be employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image may be obtained. The dye-donor element may also contain a colorless area which may be transferred to the receiving element to provide a protective overcoat. This protective overcoat may be transferred to the receiving element by heating uniformly at an energy level equivalent to 85% of that used to print maximum image dye density.

Thermal printing heads which may be used to transfer ink or dye from ink or dye-donor elements to receiving or recording elements used with the invention may be available commercially. There may be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal ink or dye transfer may be used, such as lasers as described in, for example, GB No. 2,083,726A, incorporated herein by reference.

A thermal ink or dye transfer assemblage may comprise (a) an ink or dye-donor element, and (b) an ink or dye-receiving or recording element as described above, the ink or dye-receiving or recording element being in a superposed relationship with the ink or dye-donor element so that the ink or dye layer of the donor element may be in contact with the ink or dye image-receiving or recording layer of the receiving or recording element.

When a three-color image is to be obtained, the above assemblage may be formed on three occasions during the time when heat may be applied by the thermal printing head. After the first dye is transferred, the elements may be peeled apart. A second dye-donor element (or another area of the donor element with a different dye area) may be then brought in register with the dye-receiving or recording element and the process repeated. The third color may be obtained in the same manner.

The dye-transfer dye-image receiving layer typically would comprise a polymeric binder. Typical polymeric binders may be polyester or polycarbonate. In a preferred embodiment, the polymeric binder comprises both polyester and polycarbonate polymer. Typical weighted ratios of the polyester to the polycarbonate of the binder may be in the range of 0.8-4.0 to 1.

It may be sometimes desirable for the thermal dye-transfer dye-image receiving layer to also comprise other additives. Lubricants may be added to enable improved conveyance through a printer. An example of a lubricant is a polydimethylsiloxane-containing copolymer. A preferred lubricant may be a polycarbonate random terpolymer of bisphenol A, diethylene glycol, and polydimethylsiloxane block unit and may be present in an amount of from 10% to 30% by weight of the image recording layer. Other additives that may be included in the thermal dye-transfer dye-image receiving layer may be plasticizers. Typical plasticizers that may be used comprise ester or polyester. A preferred plasticizer may be a mixture of 1,3-butylene glycol adipate and dioctyl sebacate. This plasticizer would typically be present in the dye-transfer dye-image receiving layer in a combined total amount of from 4% to 20% by weight of the dye-receiving layer.

In another embodiment, the imaging element may comprise an electrophotographic imaging element. The electrographic and electrophotographic processes and their individual steps have been well described in the prior art. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, may be accomplished by a variety of methods. The electrophotographic process of copiers uses imagewise photodischarge, through analog or digital exposure, of a uniformly charged photoconductor. The photoconductor may be a single use system, or it may be rechargeable and reimageable, like those based on selenium or organic photoreceptors.

In an alternate electrographic process, electrostatic images are created ionographically. The latent image is created on dielectric (charge holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to an electrophotographic image receiving element. The receiving element is charged electrostatically, with the polarity chosen to cause the toner particles to transfer to the receiving element. Finally, the toned image is fixed to the receiving element. For self-fixing toners, residual liquid is removed from the receiving element by air drying or heating. Upon evaporation of the solvent, these toners form a film bonded to the receiving element. For heat-fusible toners, thermoplastic polymers are used as part of the particle. Heating both removes residual liquid and fixes the toner to receiving element.

The following examples are provided to illustrate the invention. In all the examples the support was created as follows.

Support

The imaging supports used in the following examples and comparative samples comprise a paper core laminated on both the image receiving side and the opposite side. The laminate on the image receiving side was a commercially available packaging film OPPalyte® K18 TWK made by ExxonMobil. OPPalyte® K18 TWK is a composite film (37 μm thick) (specific gravity 0.62) consisting of a microvoided and oriented polypropylene core (approximately 73% of the total film thickness), with a titanium dioxide pigmented non-microvoided oriented polypropylene layer on each side; the void-initiating material is poly(butylene terephthalate). Reference is made to U.S. Pat. No. 5,244,861 where details for the production of this laminate are described at col. 3, line 24 to col. 6, line 62, incorporated herein by reference. The laminate on the opposite side was a commercially available oriented polypropylene film Bicor 70 MLT made by ExxonMobil. Bicor 70MLT (18 μm thick) (specific gravity 0.9) is a one side matte finish and one side treated polypropylene film comprising a non-microvoided polypropylene core. The subbing layers were coated on the laminate (OPPalyte® K18 TWK) surface on the image receiving side after corona discharge treatment.

Dye Receiving Layer (DRL)

Polyester E-2 (structure and making of branched polyester described in U.S. Pat. No. 6,897,183 at col. 15, lines 3-32, incorporated herein by reference, and U.S. Pat. No. 7,091,157 at col. 31, lines 23-51, incorporated herein by reference, was dried in a Novatech desiccant dryer at 43° C. for 24 hours. The dryer was equipped with a secondary heat exchanger so that the temperature will not exceed 43° C. during the time that the desiccant was recharged. The dew point was −40° C.

Lexan 151, a polycarbonate from GE, Lexan EXRL1414TNA8A005T, a polycarbonate from GE, and MB50-315 silicone from Dow Chemical Co. were mixed together in a 0.819:1:0.3 ratio and dried at 120° C. for 2-4 hours at −40° C. dew point.

Dioctyl Sebacate ('DOS) was preheated to 83° C., and phosphorous acid was mixed in to make a phosphorous acid concentration of 0.4%. This mixture was maintained at 83° C. and mixed for 1 hour under nitrogen before using.

These materials were then used in the compounding operation. The compounding was done on a Leistritz ZSK 27 extruder with a 30:1 length to diameter ratio. The Lexan-polycarbonates/MB50-315-silicone material was introduced into the compounder first, and melted. Then the dioctyl sebacate/phosphorous acid solution was added, and finally the polyester was added. The final formula was 73.46% polyester, 8.9% LEXAN 151 polycarbonate, 10 wt. % Lexan EXRL1414TNA8A005T, 3% MB50-315 silicone, 5.33% DOS, and 0.02% phosphorous acid. A vacuum was applied with slightly negative pressure, and the melt temperature was 240° C. The melted mixture was then extruded through a strand die, cooled in 32° C. water and pelletized. The pelletized dye receiver was then aged for about 2 weeks.

The dye receiver pellets were then predried before extrusion, at 38° C. for 24 hours in a Novatech dryer described above. The dried material was then conveyed using desiccated air to the extruder.

Tie Layer

Different resins were combined to form the extruded tie layer compositions. For the examples highlighted here, two polyolefin-polyether block copolymers and one polyamide-polyether block copolymer were used as antistatic polymers. The PELESTAT® 230 is a higher viscosity resin than PELESTAT® 300 when compared at the same temperature and shear rate. For the matrix polymer (s), EMA, EEA as well as polypropylene were used by themselves or in blends. The characteristics of the resins used are provided in Table 1. For resins where melt flow rate (MFR) is indicated, they were measured using ASTM D1238 for polypropylene at 230° C., under a load of 2.16 kg, while ethylene and acrylate copolymers were measured at 190° C. under a load of 2.16 kg. The higher the MFR, the easier flowing was the polymer or the lower was the viscosity of the polymer. The Vicat point as well as acrylate content of copolymers of ethylene are listed.

TABLE 1

| | | Resin description | |
|---|---|---|---|
| Resin I.D. | Source | Resin Type | Resin characteristics |
| PELESTAT ® 300 | Sanyo Chemical | Antistatic polymer | Polyolefin-polyether block copolymer |
| PELESTAT ® 230 | Sanyo Chemical | Antistatic polymer | Polyolefin-polyether block copolymer |
| Pebax 1074 | Arkema | Antistatic polymer | Polyaamide-polyether block copolymer |
| SP2207 | Eastman Chemical | Matrix polymer | Ethylene methyl acrylate copolymer, 20% acrylate content, 51.11° C. Vicat point, 6 MFR |
| Amplify EA102 | Dow Chemical | Matrix polymer | Ethylene ethyl acrylate copolymer, 18.5% acrylate content, 56.11° C. Vicat point, 6 MFR |
| Amplify EA103 | Dow Chemical | Matrix polymer | Ethylene ethyl acrylate copolymer, 19.5% acrylate content, 48.89° C., Vicat point, 21 MFR |
| Optema TC130 | Exxon Mobil | Matrix polymer | Ethylene methyl acrylate copolymer, 21.5% acrylate content, 44.4° C. Vicat point, 20 MFR |
| P4G2Z-159 | Huntsman | Matrix polymer | Homopolymer polypropylene (PP), 1.9 MFR |
| Pro-fax PDC1292 | Basell Polyolefins | Secondary (minor) component in matrix polymer | Homopolymer polypropylene, 34 MFR |
| Pro-fax HP564S | Basell Polyolefins | Secondary (minor) component in matrix polymer | Homopolymer polypropylene, melt flow rate (MFR) 38 MFR |

TABLE 1-continued

| Resin description | | | |
|---|---|---|---|
| Resin I.D. | Source | Resin Type | Resin characteristics |
| Metocene X11291-36-4 | Basell Polyolefins | Secondary (minor) component in matrix polymer | Homopolymer polypropylene, 1200 MFR |
| P9H8M-015 | Huntsman | Matrix polymer also used as secondary (minor) component in matrix polymer | Polypropylene, 53 MFR |
| Orevac CA100 | Arkema | Secondary (minor) component in matrix polymer | Maleated polypropylene, |
| Optema TC220 | Exxon Mobil | | Ethylene methyl acrylate copolymer, Vicat point 45° C., 24% acrylate content, 5 MFR |

Extrusion Equipment

The dye receiver pellets were introduced into a liquid cooled hopper which fed a 6.3 cm single screw extruder from Black Clawson. The dye receiver pellets were melted in the extruder and heated to 265° C. The pressure was then increased through the melt pump, and the DRL melt was pumped through a Cloeren coextrusion feedblock.

The tie layer pellets were introduced into a liquid cooled hopper of another 6.3 cm single screw extruder. The tie layer pellets were also heated to a temperature determined by the requirements of the composition and then pumped to the Cloeren coextrusion feedblock. For all the variations, the melt exiting the die was adjusted to be around 299° C.

The layers were coextruded through a die with a die gap set around 0.46 mm, and whose width was about 1270 mm. The layers were extrusion coated. The distance between the die exit and the nip formed by the chill roll and the pressure roll was kept at around 120 mm. The line speed for all the variations was 243.8 m/min and no draw resonance was observed.

The tie layer was coated to achieve a 1 micron thickness on the support. The tie layer was coextruded with the DRL such that the ratio of DRL thickness to the tie layer thickness coated on the support was varied from 1.5:1 to 3:1.

Rheology of the tie layers as well as components of tie layer was determined at different shear rates and temperatures. This enabled an understanding of the encapsulating phase in the tie layer. Certain tie layers were also compression molded into plaques and moisture pickup was characterized at 22.78° C. The samples created were also evaluated for adhesion prior to printing, and surface charge on DRL immediately after printing. Adhesion was characterized on unprinted samples using a 3M tape Nos. 710 with a scribe line placed in the DRL surface to help initiate separation at the correct location. Furthermore peel or separation forces were also measured during the characterization using a tension scale. The test was based on ASTM D3359.

Control

The DRL and the subbing layer were coated out of solvent and were crosslinked. The control crosslinked receiver was created by coating organic solvent based subbing layers, as per Example 5, Sample E-6 of U.S. Pat. No. 5,858,916 (col. 11; lines 40-60), incorporated herein by reference, over the corona discharge treated surface of the laminate (OPPalyte® K18TWK) on the image receiving side of the support. The subbing layers comprised a mixture of an aminofunctional organo-oxysilane and a hydrophobic organo-oxysilane in 1:1 weight ratio and LiCl, coated from a primarily alcohol based coating composition. The DRL comprised a plasticized, crosslinked layer similar to Control Receiver C-2, as described in U.S. Pat. No. 6,291,396 at col. 6, line 61 to col. 7, line 14, incorporated herein by reference.

EXAMPLE 1

Humidity Sensitive Control

The tie layer was created using melt compounding. It consisted of compounding or melt mixing polyether-polyolefin antistatic material from Sanyo Chemical Co., PELESTAT® 300 and Huntsman P4G2Z-159 polypropylene homopolymer in a 70:30 ratio at about 240° C. Prior to compounding PELESTAT® 300 was dried at 77° C. for 24 hours in Novatech dryers. The polymer was then forced through a strand die into a 20° C. water bath and pelletized. The compounded tie layer pellets were then dried again at 77° C. for 24 hours in a Novatech dryer and conveyed using dessicated air to the extruder. The tie layer was melted in the extruder such that it exited the extruder at a temperature around 232° C. See Examples 1 and 3 of U.S. Patent Publication No. 2004/0167020). The ratio of DRL to tie layer thickness was 2:1.

EXAMPLE 2

Invention

The tie layer was created using melt compounding. It consisted of melt mixing 20 wt. % PELESTAT® 230 polyether-polyolefin antistatic material from Sanyo Chemical Co., and 80 wt. % Eastman chemical SP2207 ethylene methylacrylate copolymer at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 3:1.

EXAMPLE 3

Invention

The tie layer was created using melt compounding. It consisted of melt mixing 20 wt. % PELESTAT® 230 polyether-polyolefin antistatic material from Sanyo Chemical Co., 75 wt. % Dow chemical Amplify EA102 ethylene ethylacrylate copolymer and 5 wt. % Basell Pro-fax PDC1292 a homopolymer polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 1.5:1.

EXAMPLE 4

Invention

The tie layer was created using melt compounding. It consisted of melt mixing 20 wt. % PELESTAT® 230 polyether-polyolefin antistatic material from Sanyo Chemical Co., 37.5 wt. % Dow chemical Amplify EA102 ethylene ethylacrylate copolymer, 37.5 wt. % Dow chemical Amplify EA103 ethylene ethylacrylate copolymer and 5 wt. % Basell Pro-fax PDC1292 a homopolymer polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 2:1.

EXAMPLE 5

Invention

The tie layer was created using melt compounding. It consisted of melt mixing 20 wt. % PELESTAT® 230 polyether-polyolefin antistatic material from Sanyo Chemical Co., 75 wt. % Dow chemical Amplify EA103 ethylene ethylacrylate copolymer and 5 wt. % Basell Pro-fax PDC1292 a homopolymer polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 2:1.

EXAMPLE 6

Invention

The tie layer was created using melt compounding. It consisted of melt mixing 20 wt. % PELESTAT® 230 polyether-polyolefin antistatic material from Sanyo Chemical Co., 30 wt. % Dow chemical Amplify EA103 ethylene ethylacrylate copolymer, 45 wt. % Dow chemical Amplify EA102 ethylene ethylacrylate copolymer and 5 wt. % Basell Pro-fax PDC1292 a homopolymer polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 2:1.

EXAMPLE 7

Invention

The tie layer was created using melt compounding. It consisted of melt mixing 20 wt. % PELESTAT® 230 polyether-polyolefin antistatic material from Sanyo Chemical Co., 70 wt. % Dow chemical Amplify EA102 ethylene ethylacrylate copolymer and 10 wt. % Basell Metocene X11291-136-4 a homopolymer polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 2:1.

EXAMPLE 8

Invention

The tie layer was created using melt compounding. It consisted of melt mixing 20 wt. % PELESTAT® 230 polyether-polyolefin antistatic material from Sanyo Chemical Co., 28 wt % Dow chemical Amplify EA103, 42 wt. % Dow chemical Amplify EA102 ethylene ethylacrylate copolymer and 10 wt. % Basell Pro-fax PDC1292 a homopolymer polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 2:1.

EXAMPLE 9

Invention

The tie layer was created using melt compounding. It consisted of melt mixing 15 wt. % PELESTAT® 230 polyether-polyolefin antistatic material from Sanyo Chemical Co., 30 wt. % Dow chemical Amplify EA103 ethylene ethylacrylate copolymer, 45 wt. % Dow chemical Amplify EA102 ethylene ethylacrylate copolymer and 10 wt. % Basell Pro-fax HP564S a homopolymer polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 2:1. The tie layer also was compression molded into a plaque.

EXAMPLE 10

Invention

The tie layer was created using melt compounding. It consisted of melt mixing 20 wt. % PELESTAT® 230 polyether-polyolefin antistatic material from Sanyo Chemical Co., 28 wt. % Dow chemical Amplify EA103 ethylene ethylacrylate copolymer, 42 wt. % Dow chemical Amplify EA102 ethylene ethylacrylate copolymer and 10 wt. % Basell Pro-fax HP564S a homopolymer polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 3:1. The tie layer also was compression molded into a plaque.

EXAMPLE 11

Invention

The tie layer was created using melt compounding. It consisted of melt mixing 30 wt. % PELESTAT® 230 polyether-polyolefin antistatic material from Sanyo Chemical Co., 24 wt. % Dow chemical Amplify EA103 ethylene ethylacrylate copolymer, 36 wt. % Dow chemical Amplify EA102 ethylene ethylacrylate copolymer and 10 wt. % Basell Pro-fax HP564S a homopolymer polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The tie layer also was compression molded into a plaque.

EXAMPLE 12

Invention

The tie layer was created using melt compounding. It consisted of melt mixing 40 wt. % PELESTAT® 230 polyether-polyolefin antistatic material from Sanyo Chemical Co., 20 wt. % Dow chemical Amplify EA103 ethylene ethylacrylate copolymer, 30 wt. % Dow chemical Amplify EA102 ethylene ethylacrylate copolymer and 10 wt. % Basell Pro-fax HP564S a homopolymer polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was compression molded into a plaque.

EXAMPLE 13

Invention

The tie layer was created using melt compounding. It consisted of melt mixing 20 wt. % PELESTAT® 230 polyether-polyolefin antistatic material from Sanyo Chemical Co., 15 wt. % Dow chemical Amplify EA103 ethylene ethylacrylate copolymer, 60 wt. % Dow chemical Amplify EA102 ethylene ethylacrylate copolymer and 5 wt. % Basell Pro-fax PDC1292 a homopolymer polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 2:1.

EXAMPLE 14

Invention

The tie layer was created using melt compounding. It consisted of melt mixing 20 wt. % PELESTAT® 230 polyether-polyolefin antistatic material from Sanyo Chemical Co., 75 wt. % Exxon Mobil Optema TC130 ethylene methylacrylate copolymer and 5 wt. % Basell Metocene X11291-36-4 a high MFR homopolymer polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 3:1.

EXAMPLE 15

Invention

The tie layer was created using melt compounding. It consisted of melt mixing 20 wt. % PELESTAT® 230 polyether-polyolefin antistatic material from Sanyo Chemical Co., 70 wt. % Exxon Mobil Optema TC130 ethylene methylacrylate copolymer and 10 wt. % Basell Metocene X11291-36-4 a high MFR homopolymer polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 3:1.

EXAMPLE 16

Invention

The tie layer was created using melt compounding. It consisted of melt mixing 20 wt. % PELESTAT® 230 polyether-polyolefin antistatic material from Sanyo Chemical Co., 60 wt. % Exxon Mobil Optema TC130 ethylene methylacrylate copolymer and 20 wt. % Basell Metocene X11291-36-4 a high MFR homopolymer polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 3:1.

EXAMPLE 17

Invention

The tie layer was created using melt compounding. It consisted of melt mixing 20 wt. % PELESTAT® 230 polyether-polyolefin antistatic material from Sanyo Chemical Co., 70 wt. % Exxon Mobil Optema TC130 ethylene methylacrylate copolymer and 10 wt. % Huntsman P9H8M-015 an extrusion coating grade polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 3:1.

EXAMPLE 18

Invention

The tie layer was created using melt compounding. It consisted of melt mixing 16 wt. % PELESTAT® 230 polyether-polyolefin antistatic material from Sanyo Chemical Co., 64 wt. % Exxon Mobil Optema TC130 ethylene methylacrylate copolymer and 20 wt. % Huntsman P9H8M-015 an extrusion coating grade polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 3:1.

EXAMPLE 19

Invention

The tie layer was created using melt compounding. It consisted of melt mixing 16 wt. % PELESTAT® 230 polyether-polyolefin antistatic material from Sanyo Chemical Co., 64 wt. % Exxon Mobil Optema TC130 ethylene methylacrylate copolymer and 20 wt. % Basell Pro-fax PDC1292 a homopolymer polypropylene at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 3:1.

EXAMPLE 20

Invention

The tie layer was created using melt compounding. It consisted of melt mixing 30 wt. % Pebax 1074 polyether-polyamide antistatic material from Arkema, 59 wt. % Huntsman P9H8M-015 an extrusion coating grade polypropylene and 11 wt. % Arkema Orevac CA100 a maleic anhydride grafted polypropylene at about 240° C.

Prior to compounding Pebax 1074, it was dried at 65.6° C. for 8 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 3:1.

EXAMPLE 21

Invention

The tie layer was created using melt compounding. It consisted of melt mixing 20 wt. % PELESTAT® 230 polyether-polyolefin antistatic material from Sanyo Chemical Co., and 80 wt. % Dow Chemical Amplify EA103 ethylene ethylacrylate copolymer at about 240° C.

Prior to compounding PELESTAT® 230 was dried at 77° C. for 24 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 2:1.

EXAMPLE 22

Invention

The tie layer was created using melt compounding. It consisted of melt mixing 20 wt. % Pebax 1074 polyether-polyamide antistatic material from Arkema, and 80 wt. % Optema TC130 ethylene methylacrylate copolymer at about 240° C.

Prior to compounding Pebax 1074, it was dried at 65.6° C. for 8 hours in Novatech dryers. The polymer was then forced through a strand die into a 20° C. water bath and pelletized. The compounded tie layer pellets were then dried again at 43.3° C. for 8 hours in a Novatech dryer and conveyed using dessicated air to the extruder. The tie layer was melted in the extruder such that it exited the extruder at a temperature around 265° C. The ratio of DRL to tie layer thickness was 3:1.

Table 2 compares the control sample with Example 1 (Comparative Humidity Sensitive Control), Example 2 (Inventive: EMA major polymer component with 20% antistat) and 21 (Inventive: EEA major polymer component with 20% antistat). This table highlights similarities between control sample and Example 1, 2 and 21. Example 1 (U.S. Patent Publication No. 2004/0167020) as well as Example 2, 21 and 22 (Inventive: EMA, from a different manufacturer than Example 21, major polymer component with 20% antistat) have good adhesion to the substrate and do not show delamination prior to printing. Examples 2, 21 and 22 are non-crosslinked tie layers, where the antistatic polymer component is the minor component of tie layer composition in comparison to Example 1, which has antistatic polymer as a major component of tie layer and is taken from U.S. Patent Publication No. 2004/0167020. Thus since acrylate copolymer of ethylene is the continuous phase, these examples highlight that the acrylate copolymers of ethylene is the adhesive component between the substrate and DRL.

TABLE 2

Tie layer composition, continuous phase determination and adhesion characteristics

| Example | Antistat (%) | Polymer component (%) | Adhesion prior to printing | Viscosity ratio of antistatic polymer to other polymer $\left(\frac{\eta_2}{\eta_1}\right)$@ shear rate of 1s – 1 and 293° C. | Viscosity ratio of antistatic polymer to other polymer $\left(\frac{\eta_2}{\eta_1}\right)$@ shear rate of $10s^{-1}$ and 293° C. | Comments based on equation 2 |
|---|---|---|---|---|---|---|
| Control crossliniked, solvent coated receiver | LiCl | aminofunctional organo-oxysilane and a hydrophobic organo-oxysilane | Does not delaminate | Not applicable | Not applicable | Not applicable |
| 1 | contains 70% moisture sensitive antistatic polymer) U.S. Pat. Pub. No. 2004/0167020 | 30% PP P4G2Z-159 | Does not delaminate | 348.9 | 168 | Antistatic polymer is the major phase (encap-sulating phase) |
| 2 | 20% moisture sensitive antistatic polymer | 80% EMA SP2207 | Does not delaminate | 6.81 | 4.87 | Acrylate (EMA) copolymer of ethylene is the major phase |
| 21 | 20% moisture sensitive antistatic polymer | 80% Amplify EA103 | Does not delaminate | 2.84 | 2.46 | Acrylate (EEA) copolymer of ethylene is the major phase |
| 22 | 20% moisture sensitive antistatic polymer | 80% Optema TC130 | Does not delaminate | 1.34 | 1.37 | Acrylate (EMA) copolymer of ethylene is the major phase |

Table 3 shows different tie layer compositions of the invention, involving the use of a major polymer component combined with a secondary polymer component to form a blend, having good adhesion to the DRL and the substrate. It is observed from Table 3 that different tie layer compositions can be created which have good adhesion to substrate while keeping the antistat polymer as a minor component. Examples 2, 3, 4 5, 6 and 14 illustrate a feature of the invention in which the major component of tie layer is the acrylate copolymers of ethylene. Furthermore, Example 3, 4, 5, 6 and 14 show addition of polypropylene (PP) in quantities as high as 5 wt. % does not deteriorate adhesion to the DRL and substrate when compared to Example 2 that does not contain polypropylene.

TABLE 3

Effect of addition of polypropylene to tie layer composition on adhesion

| Example | Antistat (%) | Major polymer component (%) | Minor polymer component (%) | Adhesion prior to printing |
|---|---|---|---|---|
| 21 | 20% moisture sensitive antistatic polymer | 80% EEA polymer (Amplify EA103)) | | Does not delaminate |
| 3 | 20% moisture sensitive | 75% EEA polymer (Amplify | 5% polypropylene (Pro-fax | Does not delaminate |

TABLE 3-continued

Effect of addition of polypropylene to tie layer composition on adhesion

| Example | Antistat (%) | Major polymer component (%) | Minor polymer component (%) | Adhesion prior to printing |
|---|---|---|---|---|
| | antistatic polymer | EA102) | PDC1292) | |
| 4 | 20% moisture sensitive antistatic polymer | 37.5% EEA polymer (Amplify EA102), 37.5% EEA polymer (Amplify EA103) | 5% polypropylene (Pro-fax PDC1292) | Does not delaminate |
| 5 | 20% moisture sensitive antistatic polymer | 75% EEA polymer (Amplify EA103) | 5% polypropylene (Pro-fax PDC1292) | Does not delaminate |
| 6 | 20% moisture sensitive antistatic polymer | 30% EEA polymer (Amplify EA102), 45% EEA polymer (Amplify EA103) | 5% polypropylene (Pro-fax PDC1292) | Does not delaminate |
| 14 | 20% moisture sensitive antistatic polymer | 75% EMA (Optema TC130) | 5% polypropylene (Metocene X11291-36-4) | Does not delaminate |

Table 4 shows the effect of various levels of polypropylene by using different tie layer compositions of the invention where the antistatic polymer weight % was kept constant at 20 wt. % while the amount of polypropylene has been increased from 5 wt. % to 10 wt %. and 20 wt. %. Irrespective of the polypropylene rheology, at 10 wt % adhesion of tie layer to the DRL and laminate was good. It was observed that as polypropylene wt. % increases from 10 wt. % to 20 wt % the adhesion of tie layer to DRL weakens and there was delamination at that interface.

TABLE 4

Effect of Polypropylene rheology and Polypropylene content in tie layer on adhesion

| Example | Antistat (%) | Major polymer component (%) | Minor polymer component (%) | Adhesion prior to printing |
|---|---|---|---|---|
| 7 | 20% moisture sensitive antistatic polymer | 70% EEA (Amplify EA102) | 10% polypropylene (Metocene X11291-36-4) | Does not delaminate |
| 15 | 20% moisture sensitive antistatic polymer | 70% EMA (Optema TC130) | 10% polypropylene (Metocene X11291-36-4) | Does not delaminate |
| 16 | 20% moisture sensitive antistatic polymer | 60% EMA (Optema TC130) | 20% polypropylene (Metocene X11291-36-4) | Delaminates at DRL-tie layer interface |

TABLE 4-continued

Effect of Polypropylene rheology and Polypropylene content in tie layer on adhesion

| Example | Antistat (%) | Major polymer component (%) | Minor polymer component (%) | Adhesion prior to printing |
|---|---|---|---|---|
| 17 | 20% moisture sensitive antistatic polymer | 70% EMA (Optema TC130) | 10% polypropylene (P9H8M-015) | Does not delaminate |

Table 5 shows the desired upper limit of polypropylene by using different tie layer compositions of the invention where the antistatic polymer weight % was varied from 16 wt. %-30 wt. % while the amount of polypropylene has been increased from 20 wt %. and 59 wt. %. Example 18 and 19 shows that irrespective of type of polypropylene used at 20 wt. % a weak DRL-tie layer interface was observed and delamination was observed prior to printing in the adhesion test. This was observed in Example 16 when high melt flow rate polypropylene was used at 20 wt % (see Table 4). Furthermore, if polypropylene was the major component of the tie layer as in Example 20 delamination was observed at DRL-tie layer interface.

TABLE 5

Effect of Polypropylene content on adhesion

| Example | Antistat (%) | Major polymer component (%) | Minor polymer component (%) | Adhesion prior to printing |
|---|---|---|---|---|
| 18 | 16% moisture sensitive antistatic polymer | 64% EMA (Optema TC130) | 20% polypropylene (P9H8M-015) | Weak DRL-tie interface, delaminates |
| 19 | 16% moisture sensitive antistatic polymer | 64% EMA (Optema TC130) | 20% polypropylene (PDC1292) | Weak DRL-tie interface, delaminates |
| 20 | 30% moisture sensitive antistatic polymer | 59% poly-propylene (P9H8M-015) | 11% maleated polypropylene (Orevac CA100) | Delaminates at DRL-tie layer interface |

Table 6 illustrates the effects of differing amounts moisture sensitive antistat on the moisture pickup. The Table tabulates tie layer compositions where the antistatic polymer wt. % has been changed from 15 wt. % to 70 wt. %. It was observed that the antistatic polymer that was moisture sensitive, absorbs/takes up/picks up moisture when it was also a part of the tie layer. Furthermore, it was observed that increasing the antistatic polymer wt. % increases the moisture absorption that was measured at 80% RH and 22.78° C. It was observed that Example 1 (U.S. Patent Publication No. 2004/0167020) demonstrates 6.78 wt. % moisture pickup, while compositions containing less than or equal to 20 wt % of antistatic polymer pick up less than 2 wt % of moisture.

TABLE 6

Effect of weight % of moisture sensitive antistatic polymer on moisture pickup

| Example | Amount Moisture Sensitive Antistatic Polymer | Wt. % moisture pickup at 80% RH, 22.78° C. |
|---|---|---|
| 1 | 70% (U.S. Pat. Publication No. 2004/0167020) | 6.78 |
| 8 | 15% | 1.28 |
| 9 | 20% | 1.78 |
| 10 | 30% | 2.76 |
| 11 | 40% | 3.3 |

An important feature of the invention is a tie layer that does not delaminate under high temperature and high humidity conditions as well as has good antistatic properties in the product.

Adhesion in borderless printing at the hot and humid conditions of 35.56° C. (96° F.), 86% RH was determined using KODAK EASYSHARE Printerdock G600 as follows:

A 15-step patch image of optical density (OD) ranging from Dmin (OD<0.2) to Dmax (OD>2.0) as well as Dmax was printed for evaluation. Three prints of each image were printed. When printed using 1.007 msec/line and a resistive head voltage of 25.0 V, this is equivalent to equal energy increments ranging from a print energy of 0 Joules/Cm2 to a print energy of 1.449 Joules/cm2. Printing was done manually as described below.

The dye side of the dye-donor element was placed in contact with the dye image-receiving layer of the receiver element of the same width to form a print assembly. The print assembly was fastened to a stepper motor-driven pulling device. The imaging electronics were activated, causing the pulling device to draw the print assembly between the print head and a roller at a rate of about 80 mm/sec. The printing line time was 1.007 msec/line. After each print, the dye-donor element and receiver element were separated manually. The process was repeated for printing each of a yellow, magenta, cyan, and laminate patch on the same receiver to form monochrome, bi-chrome, and neutral color patches, as known in the art. The Status A red reflection density of each printed monochrome magenta and bi-chrome red (combination of yellow and magenta) patch of the final print 15-step patch image on the receiver was measured using a Status A green filter with anSensitometry was evaluated on the 15-step patch image using X-rite Model 820 Reflection Densitometer. The edges of all the prints were evaluated for defects such as delamination.

Since the tie layer's function is to dissipate charge during and after the printing, the effectiveness of the tie layer's antistatic characteristic is determined by measuring surface charge (potential) on a print immediately after printing in the Printerdock G600 at 22.78 oC (?) and 15% RH (low humidity). This is carried out by printing a Dmax print and placing it on a rotating drum and characterizing the surface charge using two non-contact voltmeters to measure charge on either side of center of the print. The signals are captured using a data acquisition program where the capture rate is 100 Hz. This was repeated for 3 Dmax prints for the tie layer variations. The rotational speed of the drum was in the range of 2.12 m/min-2.73 m/min. A good tie layer composition would result in a low surface charge being measured.

Table 7 illustrates both adhesion in borderless printing and antistatic features. It was observed that Examples 7, 8 and 13 and do not show edge delamination in borderless printing while Example 1 shows delamination. Furthermore, Examples 8 and 13 and show that extruded tie layer compositions of this invention have low surface voltage in printed products just after printing takes place. This behavior was similar to Example 1 even though the antistatic polymer content in the two tie layer Examples of the invention are as low as 20 wt. %. This was different from the control example where very high surface charges have been measured.

TABLE 7

Effect of tie or subbing layer composition on surface charge and adhesion

| Example | Amount of Antistatic Polymer | Major polymer component (%) | Minor polymer component (%) | Surface charge in volts after printing Dmax at 15% RH | Adhesion in borderless printing at 96° F., 86% RH |
|---|---|---|---|---|---|
| Control | LiCl | aminofunctional organo-oxysilane and a hydrophobic organo-oxysilane | Not applicable | 165.7 | No delamination |
| 1 | 70% (U.S. Pat. Pub-cation No. 2004/0167020) | 30% P4G2Z-159 | not applicable | −12 | Delamination at edge of print |
| 13 | 20% | 60% EEA (Amplify EA102) and 15% EEA (Amplify EA103) | 5% polypropylene (PDC1292)) | −17 | No delamination |
| 7 | 20% | 70% EEA (Amplify EA102) | 10% polypropylene (Metocene X11291-36-4) | Not measured | No delamination |

TABLE 7-continued

| Effect of tie or subbing layer composition on surface charge and adhesion | | | | | |
|---|---|---|---|---|---|
| Example | Amount of Antistatic Polymer | Major polymer component (%) | Minor polymer component (%) | Surface charge in volts after printing Dmax at 15% RH | Adhesion in borderless printing at 96° F., 86% RH |
| 8 | 20% | 28% EEA (Amplify EA103), 42% EEA (Amplify EA102) | 10% polypropylene (PDC1292) | Not measured | No delamination |

Thus the above examples highlight different features of this invention, low moisture take up by the tie layer that enables printing under high humidities and high temperature while maintaining antistatic features for the product that results in low surface charges (voltages) on the imaged surface (DRL) immediately after printing. The above examples also highlight antistat polymer being a minor component while the adhesion is due to the matrix polymer. The examples also highlight matrix polymer composition.

The invention claimed is:

1. An extruded imaging element comprising an extruded support bearing an extruded image receiving layer and an extruded antistatic tie layer between said extruded support and said extruded image receiving layer, wherein said extruded tie layer absorbs less than 3 weight % of moisture at 80% RH and 73° F. (22.78° C.) and comprises 5-10% polyether-containing antistatic material by weight of said extruded antistatic tie layer in a matrix polymer.

2. The extruded imaging element of claim 1 wherein a printed image on said extruded image receiving layer is borderless.

3. The extruded imaging element of claim 1 wherein said extruded support comprises polypropylene.

4. The extruded imaging element of claim 1 wherein said extruded support is a voided multilayered biaxially oriented polypropylene (BOPP) film.

5. The extruded imaging element of claim 4 wherein said voided multilayered biaxially oriented polypropylene (BOPP) film extruded support is laminated to a paper raw base, wherein said paper raw base is laminated to a second biaxially oriented polypropylene (BOPP) on the side of said paper raw base opposite to said voided multilayered biaxially oriented polypropylene (BOPP) film.

6. The extruded imaging element of claim 1 wherein said extruded antistatic tie layer is 1-2 μm in thickness.

7. The extruded imaging element of claim 1 wherein said extruded antistatic tie layer has been exposed to IR beat during manufacturing or finishing.

8. The extruded imaging element of claim 1 wherein the ratio of thickness of said extruded antistatic tie layer to said extruded image receiving layer is from 1:2 to 1:5.

9. The extruded imaging element of claim 1 wherein said polyether-containing antistatic material comprises a polyether polymeric antistatic material having polyamide blocks and polyether blocks.

10. The extruded imaging element of claim 1 wherein said polyether-containing antistatic material comprises a polyether polymeric antistatic material comprising polyolefin blocks and polyether blocks.

11. The extruded imaging element of claim 1 wherein said polyether-containing antistatic material is a block polymer having a structure wherein the polyolefin block and the polyether block are bonded together alternately and repeatedly, and wherein the polymers have a repeating unit represented by the following general formula (1),

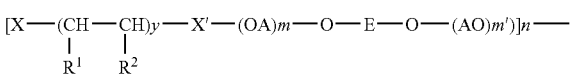

(I)

Wherein:

n is an integer of 2 to 50;

one of $R^1$ and $R^2$ is a hydrogen atom and the other is a hydrogen atom or an alkyl group containing 1 to 10 carbon atoms;

y is an integer of 15 to 800;

E is the residue of a diol after removal of the hydroxyl groups;

A is an alkylene group containing 2 to 4 carbon atoms;

m and m' each represents an integer of 1 to 300; and

X and X' are connecting groups used in the synthesis of the block.

12. The extruded imaging element of claim 1 wherein said polyether-containing antistatic material comprises a block copolymer of polyethylene oxide (polyether) segments with a polypropylene and/or polyethylene (polyolefin) segments.

13. The extruded imaging element of claim 1 wherein the weight % of said polyether-containing antistatic material satisfies the following equation $$\phi_2 < \phi_1\left(\frac{\eta_2}{\eta_1}\right) \tag{2}$$

wherein $\eta_1$ and $\eta_2$ are, respectively, the melt viscosity at the same shear rate and temperature of said matrix polymer and said antistatic material, and $\phi_1$ and $\phi_2$ are the respective volume fractions of said matrix polymer and said antistatic material, wherein the sum of $\phi_1$ and $\phi_2$ is equal to one.

14. The extruded imaging element of claim 1 wherein said matrix polymer comprises polyethylenes, polypropylenes, or copolymers thereof.

15. The extruded imaging element of claim 1 wherein said matrix polymer comprises at least one member from the group consisting of ethylene propylene copolymers, ethylene methacrylate (EMA), ethylene ethyincrylate (EEA), ethylene butylacrylate (EBA), ethylene acrylic acid (EAA) or polyl-ethylene with epoxy functionality, ethylene butyl acrylate glycidylmethylacrylate (EBAGMA), ethylene glycidyl-methacrylate (EGMA), glycidylmethacrylate, and copolymers thereof grafted with maleic anhydride.

16. The extruded imaging element of claim 1 wherein said matrix polymer comprises copolymers of ethylene having an acrylate content of greater than or equal to 12 wt% and less than 24 wt%, such that Vicat temperature of the copolymer is greater than 43° C.

17. The extruded imaging element of claim 1 wherein said matrix polymer is 80 wt % of said extruded antistatic tie layer.

18. The extruded imaging clement of claim 1 wherein said matrix polymer is composed of a major copolymer component, with one or more secondary minor polymer components.

19. The extruded imaging element of claim 18 wherein said major copolymer component comprises at least 70 wt% of polyolefins or polyolefin copolymers.

20. The extruded imaging element of claim 18 wherein said secondary minor polymer components is polypropylene, polyester, or a combination thereof.

21. The extruded imaging element of claim 18 wherein said secondary minor polymer components is polypropylene, and wherein the weight % of the polypropylene homopolymer in said extruded antistatic tie layer is chosen such that it satisfies the following equation $$\phi_3 < \phi_1\left(\frac{\eta_3}{\eta_1}\right) \tag{1}$$

wherein:

$\eta_1$ and $\eta_3$ are, respectively, the melt viscosity at the same shear rate and temperature of the acrylate copolymer of ethylene and polypropylene homopolymer, and $\phi_1$ and $\phi_3$ are their respective volume fractions of the resins.

22. The extruded imaging element of claim 21 further providing wherein the weight % of polypropylene is less than or equal to 15 wt%.

23. The extruded imaging element of claim 1 wherein said extruded image receiving layer is a thermal-dye-transfer dye-receiver element.

24. The extruded imaging element of claim 1 wherein said extruded image receiving layer is an electrophotographic image receiving layer.

25. A method of making an extruded imaging element comprising:

providing an extruded support;

extruding an antistatic tie layer onto said extruded support;

wherein said antistatic tie layer absorbs less than 3 weight % of moisture at 80% RH and 73° F. (22.78° C.) and comprises 5-10% polyether-containing antistatic material by weight of the extruded antistatic tie layer in a matrix polymer; and extruding an image receiving layer onto said extruded support and said antistatic tie layer.

26. An extruded imaging element comprising an extruded support bearing an extruded image receiving layer and an extruded antistatic tie layer between said extruded support and said extruded image receiving layer, wherein said extruded tie layer absorbs less than 3 weight % of moisture at 80% RH and 73° F. (22.78° C.) and comprises and comprises 5-20% polyether-containing antistatic material a matrix polymer, wherein the matrix polymer comprises copolymers of ethylene having an acrylate content of greater than or equal to 12 wt% and less than 24 wt%, such that Vicat temperature of the copolymer is greater than 43° C., with 5-30% polyether-containing antistatic material.

27. A method of making an extruded imaging element comprising:

providing an extruded support;

extruding an antistatic tie layer onto said extruded support, wherein said antistatic tie layer absorbs less than 3 weight % of moisture at 80% RH and 73° F. (22.78° C.) and comprises 5-20% polyether-containing antistatic material in a matrix polymer, wherein the matrix polymer comprises copolymers of ethylene having an acrylate content of greater than or equal to 12 wt% and less than 24 wt%, such that Vicat temperature of the copolymer is greater than 43° C., with 5-30% polyether-containing antistatic material; and extruding an image receiving layer onto said extruded support and said antistatic tie layer.

* * * * *